US009897331B2

(12) United States Patent
Bruin-Slot et al.

(10) Patent No.: US 9,897,331 B2
(45) Date of Patent: Feb. 20, 2018

(54) SYSTEM AND METHOD FOR MOUNTING UNDERCABINET VENTILATION HOOD

(71) Applicant: Whirlpool Corporation, Benton Harbor, MI (US)

(72) Inventors: Zachary J. Bruin-Slot, Baroda, MI (US); Andrew James Grose, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/384,039

(22) Filed: Dec. 19, 2016

(65) Prior Publication Data

US 2017/0097160 A1 Apr. 6, 2017

Related U.S. Application Data

(63) Continuation of application No. 14/305,054, filed on Jun. 16, 2014, which is a continuation-in-part of application No. 13/904,258, filed on May 29, 2013.

(51) Int. Cl.
*A47B 95/00* (2006.01)
*A47B 77/08* (2006.01)
(Continued)

(52) U.S. Cl.
CPC ..... *F24C 15/2071* (2013.01); *A47B 77/08* (2013.01); *F24F 13/0254* (2013.01); *A47B 87/02* (2013.01); *A47B 95/008* (2013.01); *F24C 15/205* (2013.01); *F24C 15/2042* (2013.01); *F24C 15/2078* (2013.01); *F24C 15/2085* (2013.01); *F24C 15/2092* (2013.01); *Y10T 29/49623* (2015.01); *Y10T 29/49826* (2015.01);
(Continued)

(58) Field of Classification Search
CPC ..... F24C 15/2071; F24C 15/2078; F24C 15/2085; F24C 15/2092; F24C 15/205; F24C 15/2042; F24C 15/00; F24F 13/0254; A47B 77/08; A47B 87/02; A47B 95/008; Y10T 29/49826; Y10T 29/51; Y10T 29/53
USPC ..... 29/525.01, 525.02, 700, 897.3; 312/111, 312/245, 257.1
See application file for complete search history.

(56) References Cited

U.S. PATENT DOCUMENTS 510,510 A * 12/1893 Johnson ..... F16B 39/32 411/206
1,467,781 A * 9/1923 Dawson ..... B42F 13/12 411/338
(Continued)

FOREIGN PATENT DOCUMENTS

CN 1888577 1/2007
DE 7530601 1/1976
(Continued)

*Primary Examiner* — Christopher Besler
*Assistant Examiner* — Bayan Salone
(74) *Attorney, Agent, or Firm* — Diederiks & Whitelaw, PLC

(57) ABSTRACT

A system and method for installing a ventilation hood to an underside of a wall cabinet includes providing structure for initially establishing mounting or anchoring points for the ventilation hood, securing first mounting structure for the ventilation hood, supporting the ventilation hood on the first mounting structure, and then further securing the ventilation hood with an additional fastening arrangement to complete the installation.

19 Claims, 24 Drawing Sheets

(51) Int. Cl.

| | |
|---|---|
| ***A47B 87/02*** | (2006.01) |
| ***F24C 15/02*** | (2006.01) |
| ***F24F 13/02*** | (2006.01) |
| ***F24C 15/20*** | (2006.01) |

(52) U.S. Cl.
CPC ..... *Y10T 29/49948* (2015.01); *Y10T 29/51* (2015.01); *Y10T 29/53* (2015.01)

(56) References Cited

U.S. PATENT DOCUMENTS 2,349,541 A 5/1944 Earle
2,839,987 A * 6/1958 Pryne ..... F24C 15/20 126/299 D
2,887,351 A * 5/1959 Allender ..... A47B 95/002 312/245
2,946,612 A 7/1960 Ahlgren
2,971,451 A 2/1961 Feig
3,098,423 A * 7/1963 Giannini ..... F24C 15/2071 126/299 D
3,125,869 A 3/1964 Winston
3,372,632 A * 3/1968 Stalker ..... F24C 15/2071 126/299 D
3,551,963 A 1/1971 Mosher, Jr. et al.
3,749,465 A * 7/1973 Newcomer ..... A47B 47/00 312/245
3,768,064 A * 10/1973 Pabich ..... H04N 5/64 24/701
3,908,328 A 9/1975 Nelsson
4,011,803 A * 3/1977 Pfaffinger ..... A47B 77/08 126/299 R
4,050,184 A 9/1977 Chiari
4,154,343 A * 5/1979 Lautenschlager ..... B65D 11/12 206/230
4,397,577 A 8/1983 Bauer
4,437,712 A * 3/1984 Wissinger ..... A47B 67/005 312/209
4,448,327 A 5/1984 Gahm
4,453,690 A * 6/1984 Takeuji ..... A47B 95/008 248/309.1
4,465,256 A * 8/1984 Wolbrink ..... A47B 77/08 248/201
4,576,355 A * 3/1986 Graf ..... A47B 95/008 248/223.41
4,580,853 A * 4/1986 Hitzeroth ..... A47B 77/02 248/317
4,614,177 A * 9/1986 Buckley ..... F24C 15/2071 126/299 D
4,628,185 A * 12/1986 Norwood ..... A47J 37/0623 219/386
4,629,185 A 12/1986 Amann
4,630,532 A * 12/1986 Sonnentag ..... A47J 31/0573 248/201
4,666,113 A * 5/1987 Itoh ..... H05B 6/642 219/756
4,753,406 A * 6/1988 Kodama ..... A47B 77/02 248/327
4,775,273 A * 10/1988 Bauer ..... F16B 2/205 403/377
4,792,195 A * 12/1988 Adriaansen ..... A47B 88/407 248/201
4,796,850 A * 1/1989 Aramaki ..... F24C 15/30 248/309.1
4,824,061 A * 4/1989 Sumikama ..... F24C 15/2042 248/225.21
5,131,711 A 7/1992 Laferle
5,207,543 A * 5/1993 Kirma ..... F16B 39/08 411/121
5,207,546 A 5/1993 Bouverie
5,274,973 A 1/1994 Liang
5,333,827 A * 8/1994 Gioscia ..... A47B 81/065 248/289.11
5,638,838 A 6/1997 Lombardi
5,774,319 A 6/1998 Carter et al.
5,775,319 A * 7/1998 Pettinari ..... F24C 15/2021 126/299 D
5,887,388 A * 3/1999 Hempel ..... F24B 1/198 126/278
6,003,212 A 12/1999 Imahata
6,209,268 B1 4/2001 Schmidt
6,222,171 B1 4/2001 Fukuda et al.
6,341,754 B1 * 1/2002 Melito ..... A47B 77/08 248/201
6,382,867 B2 5/2002 Serre
6,430,881 B1 8/2002 Duadet et al.
6,444,954 B1 * 9/2002 Blankenship ..... A47J 37/0635 219/386
6,510,619 B2 1/2003 Mills
7,129,452 B2 10/2006 Cho
7,222,925 B2 * 5/2007 Yu ..... F16M 13/02 312/223.1
7,240,459 B2 7/2007 Daudet et al.
7,654,258 B2 * 2/2010 Negandhi ..... F24C 15/20 126/299 D
7,780,128 B2 * 8/2010 Walsberg ..... A47B 91/024 248/188.2
8,079,652 B2 12/2011 Laible et al.
8,182,051 B2 5/2012 Laible et al.
8,272,377 B2 * 9/2012 Tsakiris ..... F24C 15/2071 126/299 D
9,523,507 B2 * 12/2016 Bruin-Slot ..... F24C 15/2071
2005/0246989 A1 * 11/2005 Pringle ..... E04F 13/142 52/384
2006/0042622 A1 * 3/2006 Searer ..... F24C 15/2071 126/299 R
2007/0256681 A1 * 11/2007 Chiang ..... F24C 15/2071 126/299 R
2008/0175656 A1 7/2008 Blattner et al.
2008/0184538 A1 * 8/2008 Shellnutt ..... A44B 99/00 24/326
2008/0302352 A1 * 12/2008 Pearce ..... F24C 15/2071 126/299 R
2009/0103999 A1 * 4/2009 Fucito ..... F16B 13/0808 411/342
2014/0352132 A1 * 12/2014 Bruin-Slot ..... A47B 77/08 29/525.02
2014/0352151 A1 * 12/2014 Bruin-Slot ..... F24C 15/2071 29/897.3
2015/0047198 A1 2/2015 Bruin-Slot et al.

FOREIGN PATENT DOCUMENTS

| | | |
|---|---|---|
| DE | 3417453 | 11/1985 |
| DE | 202012008040 | 9/2012 |
| DE | 102011051104 | 11/2012 |
| EP | 1621819 | 2/2006 |
| EP | 1632723 | 3/2006 |
| EP | 1939538 | 7/2008 |
| EP | 2229846 | 9/2010 |
| EP | 2546578 | 1/2013 |
| FR | 2766112 | 1/1999 |
| JP | 4897234 | 11/1973 |
| JP | 02126038 | 5/1990 |
| JP | 1151436 | 2/1999 |
| JP | 2006153395 | 6/2006 |
| JP | 2006234361 | 9/2006 |

* cited by examiner

SYSTEM AND METHOD FOR MOUNTING UNDERCABINET VENTILATION HOOD

CROSS-REFERENCE TO RELATED APPLICATIONS

This application is a continuation of U.S. patent application Ser. No. 14/305,054, filed on Jun. 14, 2014, entitled "SYSTEM AND METHOD FOR MOUNTING UNDERCABINET VENTILATION HOOD," the disclosure of which is hereby incorporated herein by reference in its entirety. This application is also a continuation-in-part of U.S. patent application Ser. No. 13/904,258, filed on May 29, 2013, entitled "SYSTEM AND METHOD FOR MOUNTING UNDERCABINET VENTILATION HOOD," the disclosure of which is hereby incorporated herein by reference in its entirety.

BACKGROUND OF THE INVENTION

Field of the Invention

The present invention pertains to the art of cooking and, more particularly, to a system and method for mounting a ventilation hood under cabinetry positioned above a cooking appliance.

Description of the Related Art

In the art of cooking, numerous types of cooking appliances are known, including both slide-in and drop-in ranges. Basically, both types of ranges are designed to be situated in a space or cut-out provided along a length of a kitchen countertop. In either case, the range includes at least one oven cavity supported below a cooktop. Of course, it is also known to separately mount cooktops, without lower oven cavities, in countertops. In any case, when the cooktop is utilized for cooking operations, a certain degree of smoke, grease or the like can be created. To counter the airborne nature of these byproducts, it is known to mount a ventilation unit above the range. Basically, such known ventilation units include an exhaust fan which functions to draw the smoke and other byproducts away from the cooktop. The byproducts are typically either directed to a vent external of the cooking area or filtered such that the cleansed air is simply expelled back into the cooking area. Such known ventilation units can take the form of a ventilation hood or can be incorporated into an overhead microwave oven mounted above the range. In many situations, the ventilation unit will also incorporate a light to aid in illuminating the cooktop.

In mounting a ventilation unit incorporated into a microwave oven to the bottom of a cabinet which is centered above and spans the appliance, it is commonplace to bolt the ventilation unit to a bottom cabinet panel. More specifically, a housing of the microwave oven is provided with spaced front and rear mounting holes and a template can be provided which enables an installer to mark drilling locations in the bottom panel of the cabinet, with the intent that the drilled holes will be aligned with pre-formed mounting holes in the unit. Assuming the proper alignment exists, the microwave oven can be held in a position beneath the upper cabinet and bolts inserted through each of the aligned hole sets to secure the microwave oven in place. In the case of a ventilation hood, the housing of the hood is typically used as a template for determining appropriate fastener locations and then filler strips are measured, cut and installed beneath the cabinet to complete lower framing needed to mount the ventilation hood.

Certain problems are considered to exist in each of these overall mounting arrangements. First of all, at least in the case ventilation units incorporated in microwave ovens, it is common for the template to take the form of a folded paper template which must be unfolded, cut to fit the underside of the upper cabinet and taped or otherwise retained in position to establish the drilling locations. Given that creases and improper cuts can contribute to misalignment issues, it is not uncommon for product manufacturers to recommend that significantly larger holes be drilled than needed to receive the bolts, and washers are provided to accommodate the enlarged holes. In this manner, a degree of tolerance is established to better assure potential alignment of each bolt with a designated hole in the ventilation unit. In the case of ventilation hoods, the measuring, cutting and mounting of filler strips can be quite tedious and time consuming, particularly if a professional installer is not employed. In both types of mounting arrangements, a second significant problem is that, after the holes are drilled and it is time to actually secure the ventilation unit, two people are required, one for holding the ventilation unit in place and the other for inserting and tightening at least a couple of the bolts. Certainly, given the confined space and the need to hold the unit around eyelevel for some time, this operation is less than desirable.

Although two people may be necessary for mounting a microwave, it is desired in accordance with the present invention to provide a method which enables a single user to readily install a ventilation hood over a cooking appliance through the use of a simplified and efficient installation system.

SUMMARY OF THE INVENTION

The present invention is directed to a system and method for mounting a ventilation hood above a cooking appliance and under a cabinet, such as in a kitchen. The cabinet incorporates standard structure, including a lower support frame having a downwardly extending rectangular flange extending beyond a bottom panel or floor of the cabinet and terminating at lateral peripheral edges. In accordance with a first aspect, the system includes left and right support brackets mounted to an upstanding wall, against which the cabinet is mounted, at spaced lateral positions aligned with the lateral peripheral edges. Each support bracket includes an upstanding projection or tab which is received in a slot provided in the back of the ventilation hood such that a rear portion of the range hood can be easily supported by a single person while the ventilation hood is being connected to the cabinet.

In accordance with another aspect of the invention, several ways are proposed for separately securing a front portion of the ventilation hood to the cabinet, while accommodating a filler space between the bottom panel of the cabinet and the bottom of the downwardly extending flange. In a first embodiment, flexible tabs are punched out of the top of a housing of the ventilation hood, partially creating enlarged openings in the top of the hood. The flexible tabs are aligned with the downwardly extending flanges of the cabinet and screws are placed upwardly at an angle of approximately 45° through the enlarged openings in the range hood and pre-formed holes in the flexible tabs to fasten the flexible tabs to the flanges. In a second embodiment, feet members are positioned between the bottom panel of the cabinet and the ventilation hood. During installation the feet may be temporarily installed in mounting holes in the ventilation hood and then the hood placed onto the brackets and moved into position under the cabinet. The feet can be selectively extended or retracted relative to the range hood based on the height of the cabinet flange, i.e., the dimension of the filler space between the bottom panel of the cabinet and the lowermost edge of the cabinet support frame. A drill is then used to drill holes through the cabinet floor using the feet as locator or pilot guides. The ventilation hood is temporarily removed from the cabinet and the feet are removed from the hood. Next, one after another, the feet are placed against the bottom panel of the cabinet and screws are installed through the bottom panel and threaded into the feet. Once again, the ventilation hood is placed on the brackets and tilted into a final position under the cabinet, allowing the feet to enter the mounting holes. Either a tool or an installer's fingers can be used to then rotate the feet until the hood is tight against the cabinet.

In another embodiment, specifically configured mounting blocks are provided for mounting to the lower support frame of the cabinet at frontal corner portions. The mounting blocks are dimensioned such that, once mounted against the lower support frame in the filler space, connectors extend downwardly from the mounting blocks. When the ventilation hood is supported on the rear brackets and tilted upwardly, mounting holes in the ventilation hood become aligned with the connectors. In accordance with one arrangement, the connectors snap-connect with the ventilation hood for a secure fit.

Various other embodiments are disclosed which employ the support brackets but which are based on drilling holes in the bottom panel of the cabinet. In one embodiment, first and second fastener elements extend from a common plate which is preconfigured to establish requisite hole locations needed in the floor of the cabinet. After forming the holes, such as through a drilling operation, each of the first and second mechanical fasteners is extended through both the bottom panel and the ventilation hood, while the plate is positioned against the bottom panel. In the case of threaded fastener elements, nuts are secured to fix the ventilation hood in place. Instead of interconnected threaded fasteners, multiple zip strips can be used to mount the ventilation hood. In accordance with this embodiment, during installation an elongated body portion of each zip strip is fed into a respective hole formed in the bottom panel and then retained in place by a retainer element. The ventilation hood is then lifted in place while the zip strips hang down through respective holes in the hood and respective zip washers or fasteners are attached to the zip strips. The ventilation hood is raised in abutment with the underside of the cabinet and the zip fasteners are ratcheted until the hood is tightly mounted to the bottom of the cabinet. The remaining part of the zip strips are then cut off. In still further embodiments, the holes formed in the bottom panel of the cabinet receive bolts having transverse holes for receiving pins, or toggle bolts are employed. In each case, the need for a template is avoided and the rear brackets function to support the ventilation hood so that a single person can hold the ventilation hood as needed during the attachment of the frontal portion of the hood to the cabinet.

Additional objects, features and advantages of the invention will become readily apparent from the following detailed description of preferred embodiments of the invention when taken in conjunction with the drawings wherein like reference numerals refer to corresponding parts in the several views.

DETAILED DESCRIPTION OF EMBODIMENTS

Figure 1:
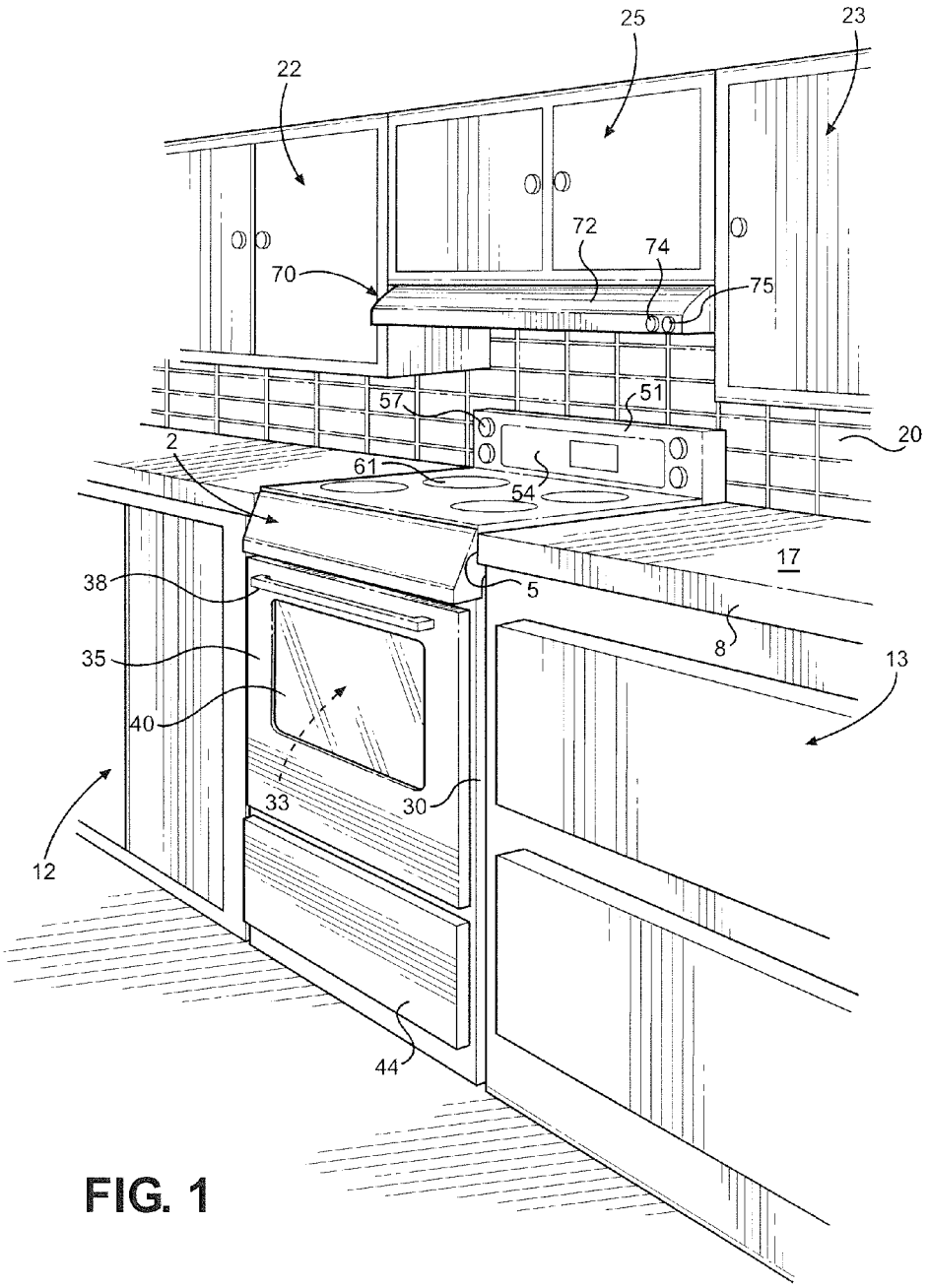
FIG. 1 is a perspective view illustrating a ventilation hood mounted in accordance with the invention to cabinetry positioned above a range in a kitchen environment.

With initial reference to FIG. 1, a cooking appliance 2 is shown positioned in a cut-out or opening 5 provided in a countertop 8 and between adjacent lower cabinetry 12 and 13. Countertop 8 has an upper surface 17 extending to a rear upstanding wall 20. Above countertop 8 are shown wall cabinets 22 and 23 mounted on either side of cooking appliance 2, as well as a central cabinet 25 arranged above a portion of cooking appliance 2 and extending between upstanding rear and side walls 21 and 22, respectively.

Within the scope of the invention, cooking appliance 2 can take on various forms, including all fuel type ranges and built-in cooktops. However, in the exemplary embodiment illustrated, cooking appliance 2 is illustrated as a range including a cabinet or shell 30 which supports an oven cavity 33 located behind a door 35 having a handle 38 and a window 40. In a manner known in the art, door 35 can be pivoted to access oven cavity 33. Also, as shown, cooking appliance 2 includes a lower drawer 44 for use in storing pans and the like. In addition, cooking appliance 2 includes an upper control panel 51 having a central oven control section 54. Furthermore, control panel 51 is shown provided with a plurality of control knobs, one of which is indicated at 57, for regulating operation of upper cooktop heating elements or burners, such as that indicated at 61.

Particularly with the inclusion of the heating elements or burners 61, operation of cooking appliance 2 can produce smoke, grease or other airborne byproducts. To counter the potential detrimental effects of these cooking byproducts, it is desired to mount a ventilation hood 70 above cooking appliance 2, specifically to the underside of central cabinet 25 and between side wall cabinets 22 and 23, to draw in and either exhaust or filter and re-direct the associated flow of air. Certainly, ventilation hoods employed for this purpose is known in the art, but the present invention is particularly directed to a system and method for mounting ventilation hood 70, specifically various mounting arrangements which enable a single installer to readily and efficiently secure ventilation hood 70 to central cabinet 25.

Figure 2:
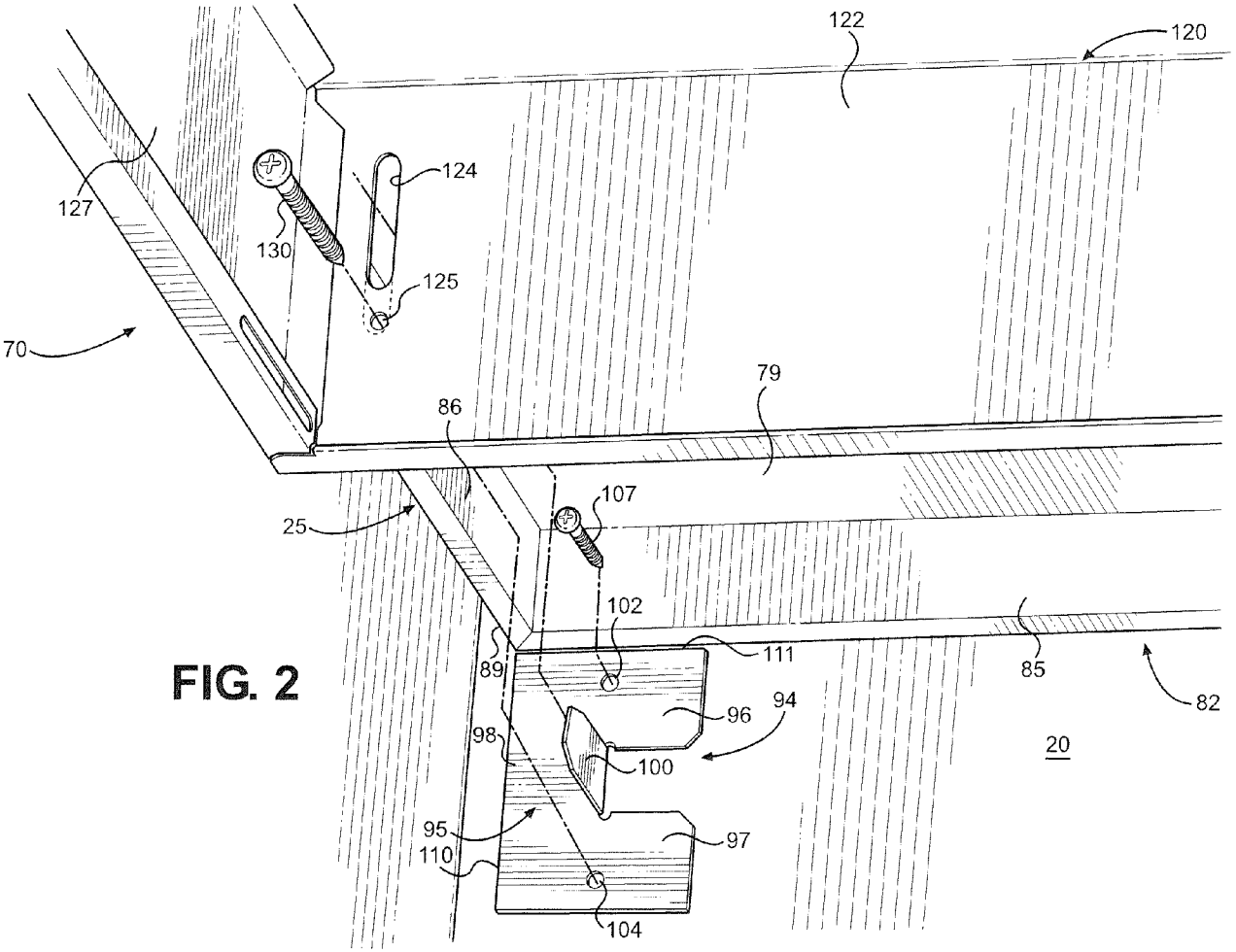
FIG. 2 is a partial exploded view of a first stage in the mounting of the ventilation hood of FIG. 1 in accordance with the invention.

In general, the operation of ventilation hood 70 is also known in the art. Therefore, apart from particular details set forth hereinafter, it should be recognized that the actual construction of ventilation hood 70 can vary from that depicted. Therefore, although ventilation hood 70 is shown to include a housing 72 and control knobs 74 and 75 for a fan and light (not shown) respectively, the invention is equally applicable to a wide range of other configurations. In connection with the mounting of ventilation hood 70, it should also be recognized that central cabinet 25 is also of known construction. That is, although the exact materials and construction can vary, central cabinet 25, as shown in FIG. 2, will almost invariably include a bottom panel or floor 79 and a lower support frame 82, shown to include a rear flange piece 85 and a side flange piece 86 which defines an outermost side edge portion 89 of central cabinet 25. Of course, corresponding structure exists on the opposing side (not shown in this figure) of cabinet 25.

In accordance with one aspect of the invention, support brackets are initially mounted at spaced locations beneath central cabinet 25. More particularly, for the left side of cabinet 25 as shown in FIG. 2, a support bracket 94 is shown to include a C-shaped base 95 having an upper portion 96, a lower portion 97 and a connecting portion 98. In the embodiment shown, support bracket 94 is made of sheet metal which is stamped to create a thin projection or tab 100. Base 95 is shown provided with an upper hole 102 and a lower hole 104. In connection with this invention, it is recognized that the outer lateral dimension of lower support frame 82 is standard based on the distance between wall cabinets 22 and 23. That is, the thicknesses of flange pieces 85 and 86 are recognized to vary, but the outermost dimension for lower support frame 82 can be readily determined based on the known spacing in which ventilation hood 70 is to be mounted.

With this information in hand, the first step in connection with the mounting method for ventilation hood 70 is to mount the support brackets 94 at predetermined positions based only on the construction of lower support frame 82. More specifically, in the embodiment shown, a first mechanical fastener 107 is positioned at upper hole 102 to mount support bracket 94 to rear wall 20 upon aligning a side edge 110 of bracket 94 with outermost edge portion 89 of side flange piece 86 and with upper edge 111 of bracket 94 extending directly along rear flange piece 85. Again, a similar mounting is done on the other lower side of cabinet 25.

As shown in this figure, ventilation hood 70 has a rear portion 120 established by a rear panel 122 which is formed with a slot 124 and a hole 125. Actually, although hole 125 is shown spaced below and generally aligned with slot 124, slot 124 could also be further elongated (shown in dotted) for a corresponding purpose as will become fully evident below. As illustrated, rear panel 122 is attached to a side panel 127 of the housing 72 of ventilation hood 70. Of particular note is the fact that rear panel 122 actually has corresponding structure at an opposing end portion (not shown in this figure) of rear panel 122 and the lateral spacing between the slots 124 is preset based on the known mounting positions for support brackets 94. More specifically, each slot 124 is positioned such that rear portion 120 can be readily supported by the mounted brackets 94 with each projection 100 extending through a respective slot 124. Therefore, at this early mounting stage, after the two spaced support brackets 94 are secured, ventilation hood 70 can be basically hung on support brackets 94 and easily supported by a single installer. The next step then concerns the manner in which a front portion of ventilation hood 70 is mounted. However, before detailing various embodiments to carry out this aspect of the invention with reference to the remaining figures, it should be realized that FIG. 2 illustrates the inclusion of a second mechanical fastener 130 for each support bracket 94. Overall, second mechanical fastener 130 is designed to be received in lower hole 104 to further secure a respective support bracket 94. However, at this time, it should be recognized that second mechanical fastener 130 can be selectively received directly in lower hole 104 or first through opening 125 (or a further elongated slot 124) in rear panel 122. In the former scenario, second mechanical fastener 130 is secured prior to supporting ventilation hood 70 on brackets 94 and, in the latter case, second mechanical fastener 130 is preferably secured after mounting the front portion of ventilation hood 70 as will now be described in detail.

Figure 3:
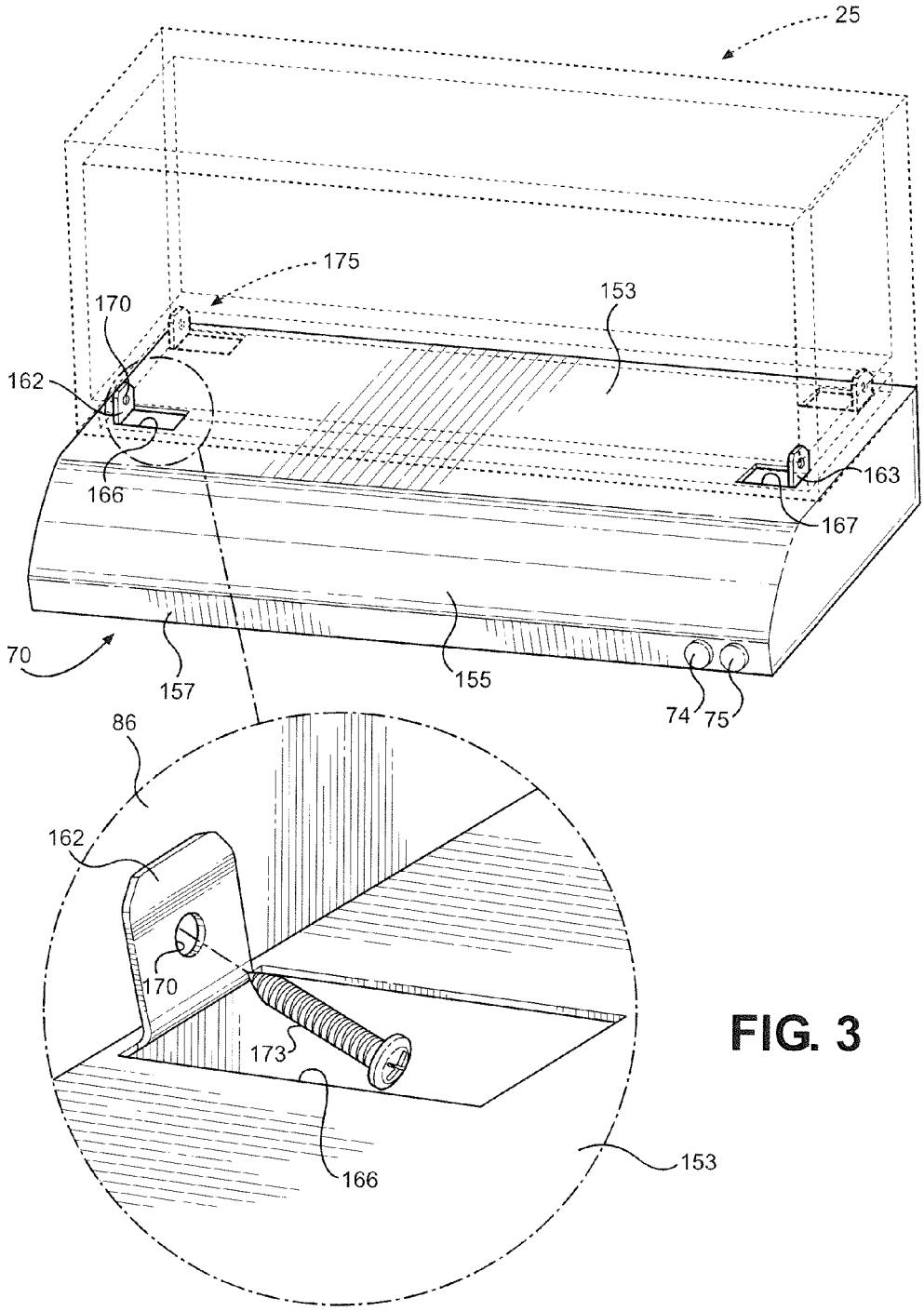
FIG. 3 is a perspective view of a first mounting embodiment.

FIG. 3 presents a first embodiment wherein the representative ventilation hood 70 is shown to include a top panel 153 which leads to a sloping section 155 and a front panel 157 to which control knobs 74 and 75 are mounted. In this exemplary arrangement, top panel 153, sloping section 155 and front panel 157 are created by bending and shaping a piece of sheet metal. In any case, out of top panel 153 is created flexible tabs 162 and 163. More specifically, top panel 153 is formed with enlarged openings 166 and 167 which are partially created by the formation of tabs 162 and 163 that have been bent so as to stand upright relative to top panel 153. Each tab 162, 163 is provided with a through hole 170 which is adapted to receive a mechanical fastener 173. In particular, each tab 162, 163 is bent so as to be positioned against a portion of lower support frame 82 of cabinet 25, such as side flange piece 86 as shown in this figure, and then mechanical fastener 173, such as a wood screw, can be arranged at an angle, such as 45°, so as to extend through hole 170 and fastened into side flange piece 86. That is, with the rear portion of ventilation hood 70 supported by brackets 94, the front portion of ventilation hood 70 can be tilted upward by the installer such that top panel 153 abuts the underside of cabinet 25, at which point each mechanical fastener 173 can be positioned through a respective enlarged opening 166, 167 to fixedly mount a corresponding tab 162, 163. To complete the mounting process, second mechanical fastener 130 (FIG. 2) can be mounted through aligned holes 125 and 104 (see FIG. 2). On the other hand, additional rear flexible tabs, such as that indicated at 175, could also be employed.

Figure 4A:
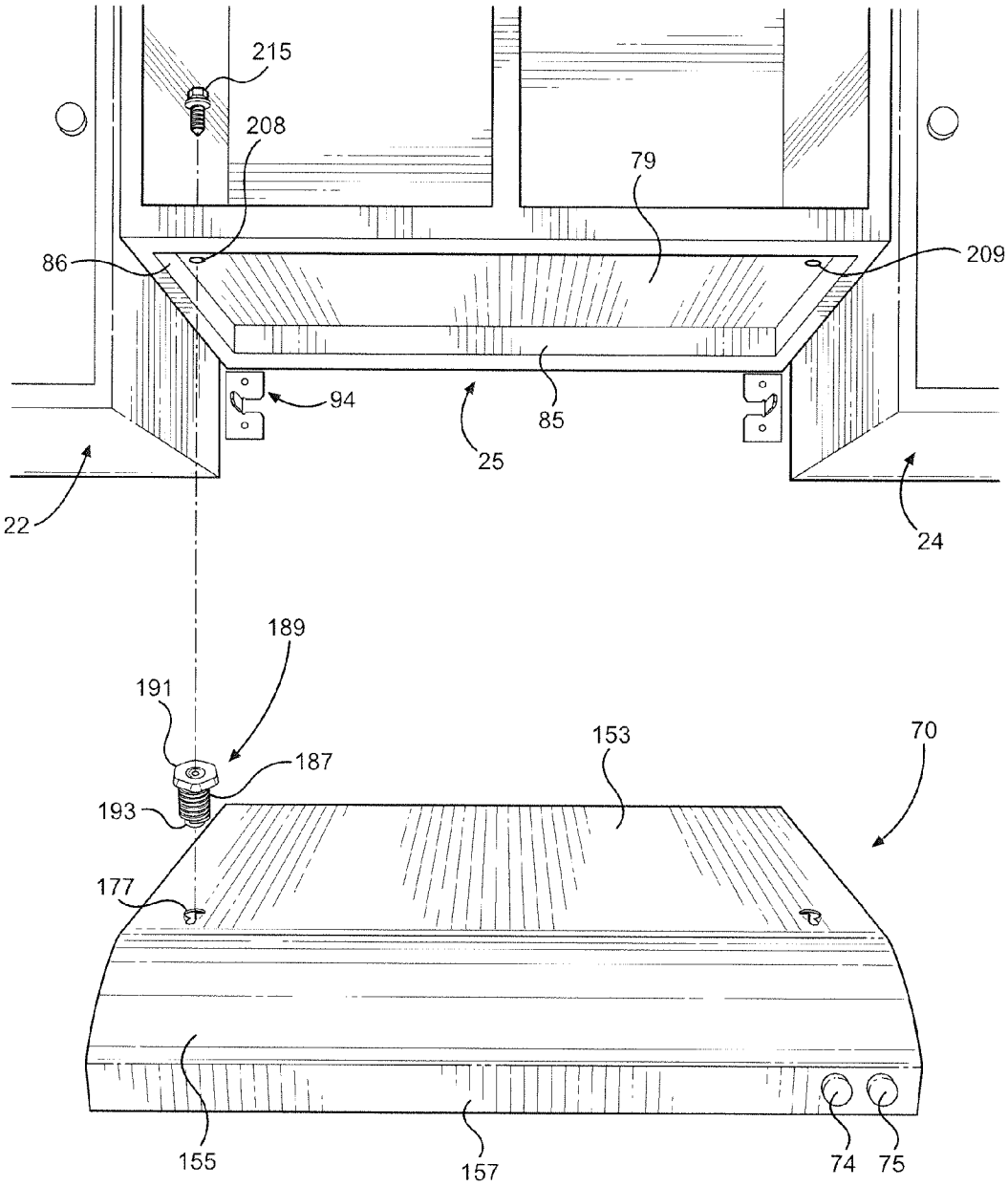
FIG. 4A is an exploded view illustrating an initial stage associated with a second mounting embodiment.
Figure 4B:
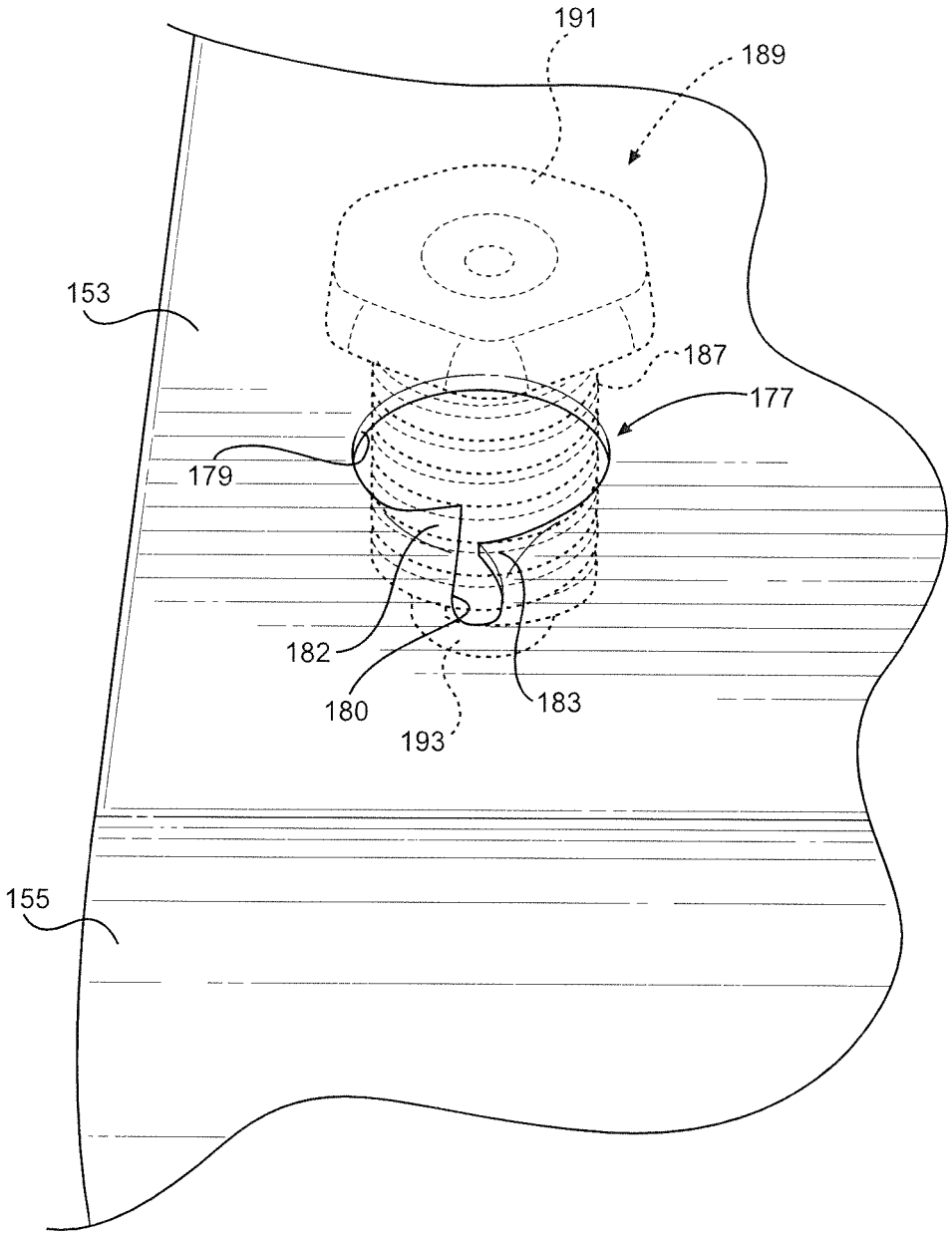
FIG. 4B shows a subsequent stage of the mounting embodiment of FIG. 4A.

FIGS. 4A-4E illustrate another mounting arrangement for the front portion of ventilation hood 70. In accordance with this embodiment, a frontal portion of top panel 153 of ventilation hood 70 is pre-formed with lateral spaced through holes 177. As best shown in FIGS. 4A and 4B, each hole 177 is defined by a large opening 179 leading to an extension opening 180 about which top panel 153 includes a raised section 182 adjacent a lowered section 183. This construction readily enables a threaded body portion 187 of a foot member 189 to be threadably attached to top panel 153. In the embodiment shown, each foot member 189 also includes a head 191 and a lower portion 193.

Figure 4C:
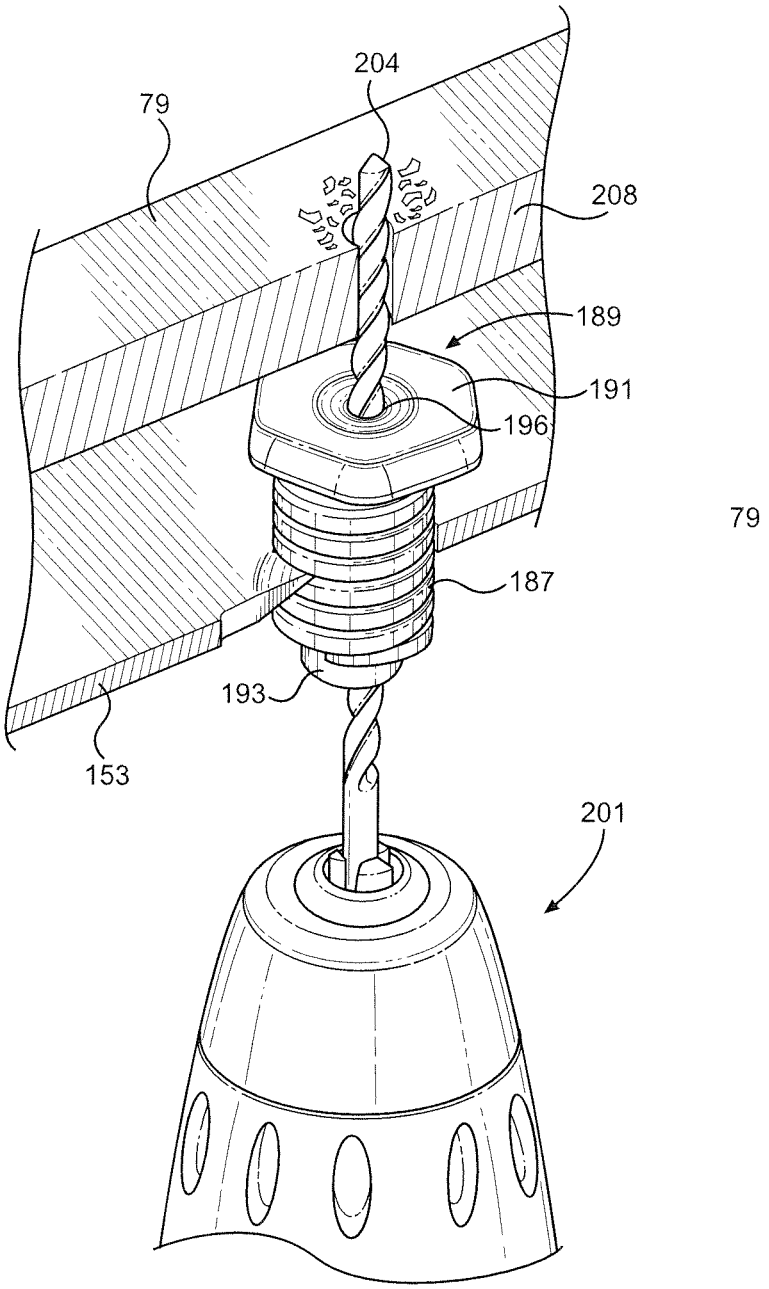
FIG. 4C illustrates another stage for the second mounting embodiment.
Figure 4D:
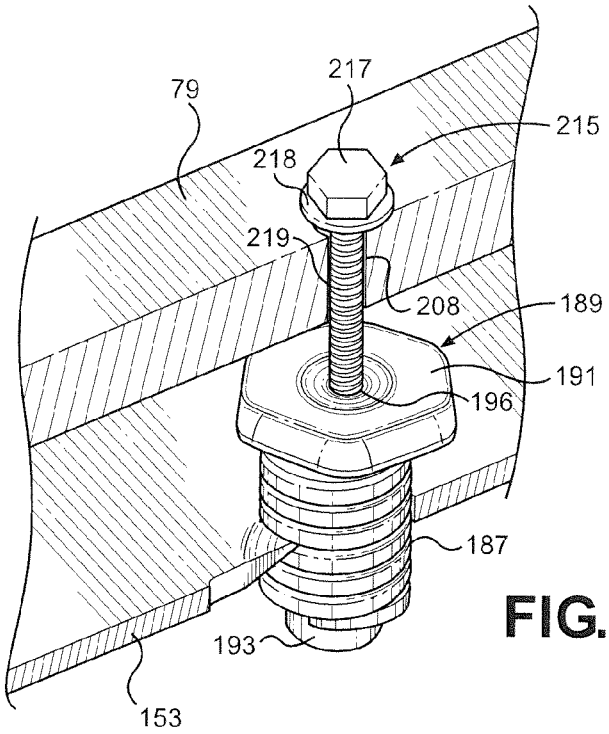
FIG. 4D depicts a still further stage of this embodiment.
Figure 4E:
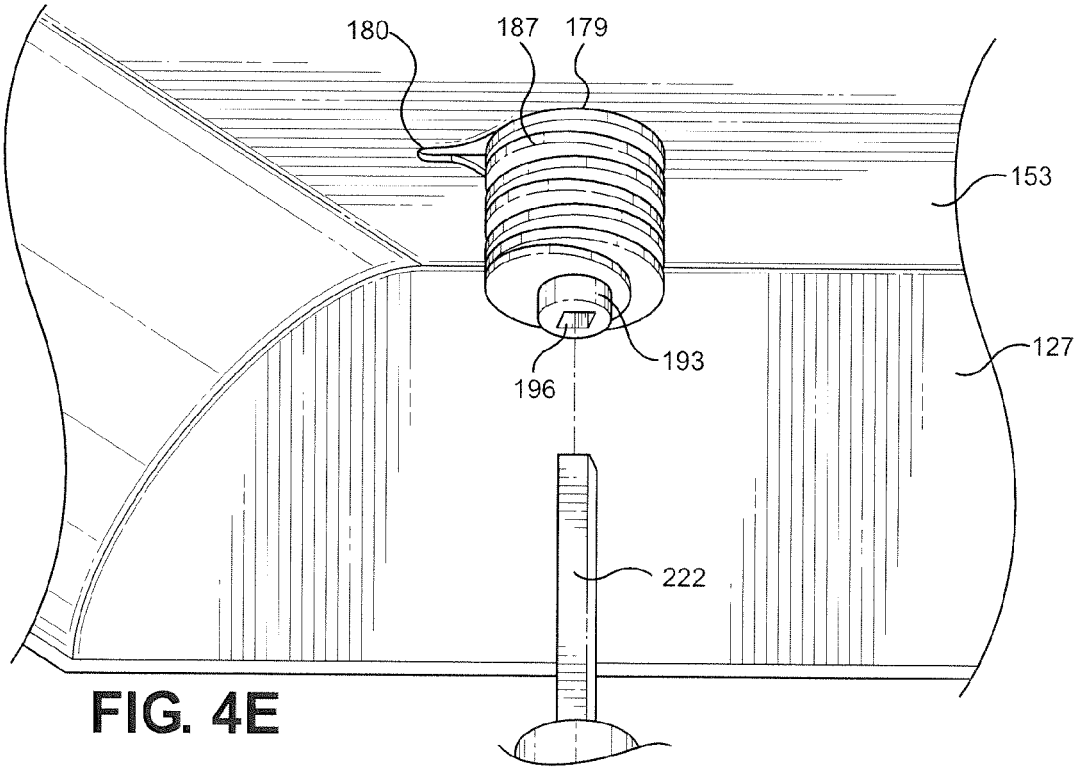
FIG. 4E illustrates a final stage of this embodiment.

Extending through each of lower portion 193, threaded body portion 187 and head 191 is a bore 196 (particularly see FIGS. 4C-4E). With this arrangement, feet members 189 can be initially, partially threaded onto top panel 153 at the large openings 179. Then, upon mounting the rear portion of ventilation hood 70 on support brackets 94 and tilting of the front portion until ventilation hood 70 is positioned against the underside of cabinet 25, a drill 201 (see FIG. 4C) having a bit 204 can be used to form holes 208 and 209 in bottom panel 79 of cabinet 25. That is, with ventilation hood 70 in a desired mounting position, bit 204 is directed through bore 196, which acts as a guide for the drilling operation, in order to establish holes 208 and 209.

At this point, two main assembly avenues can be followed. In accordance with one avenue, ventilation hood 70 can be taken off of support brackets 94 to enable the installer to secure each foot member 189 to bottom panel 79 with a mechanical fastener 215. As perhaps best represented in FIG. 4D, mechanical fastener 215, shown to include a head 217, a washer 218 and a shank 219, is positioned in hole 208 and threaded into foot member 189. This operation is performed for each foot member 189. In each case, both head 217 of mechanical fastener 215 and head 191 of foot member 189 are shaped to receive tools, such as a wrench, to enable feet members 189 to be drawn up to the underside of bottom panel 79 while enabling fastener 215 and a respective foot member 189 to still freely rotate in unison relative to cabinet 25. Thereafter, ventilation hood 70 is again supported on brackets 94 and tilted such that lower portions 193 of feet members 189 will register at openings 179. At this point, as best represented in FIG. 4E, a polygonal shaped tool 222 can be inserted into bore 196 to thread body portion 187 of each foot member 187 into a respective opening 179, thereby drawing top panel 153 firmly against cabinet 25.

In the alternative, feet members 189 can be initially threaded to top panel 153 to an extent which enables top panel 153 of ventilation hood 70 to abut the underside of cabinet 25 and then, after supporting ventilation hood 70 on brackets 94 and tilting the front end against cabinet 25, mechanical fastener 215 can be threaded into bore 196 while tool 222, or an installer's fingers, is used to prevent each foot member 189 from rotating. In either scenario, it should be recognized that the bores 196 not only establish a convenience and accurate guide for drilling of holes 208 and 209, but also enable mechanical fasteners 215 to be easily threaded therein. Most preferably, feet members 189 are formed of molded plastic. In addition, feet members 189 advantageously occupy the filler space between bottom panel 79 and top panel 153 to establish a very solid mounting arrangement which can still be readily performed by a single installer without the use of any paper template and filler strip measuring or cutting. At this point, it should be noted that tool 222 can take various forms in correspondence with the shape of bore 196. For instance, conventional hex keys could be utilized. Also, an outer surface of lower portion 193 could actually be configured to receive a tool instead of shaping bore 196.

Figure 5:
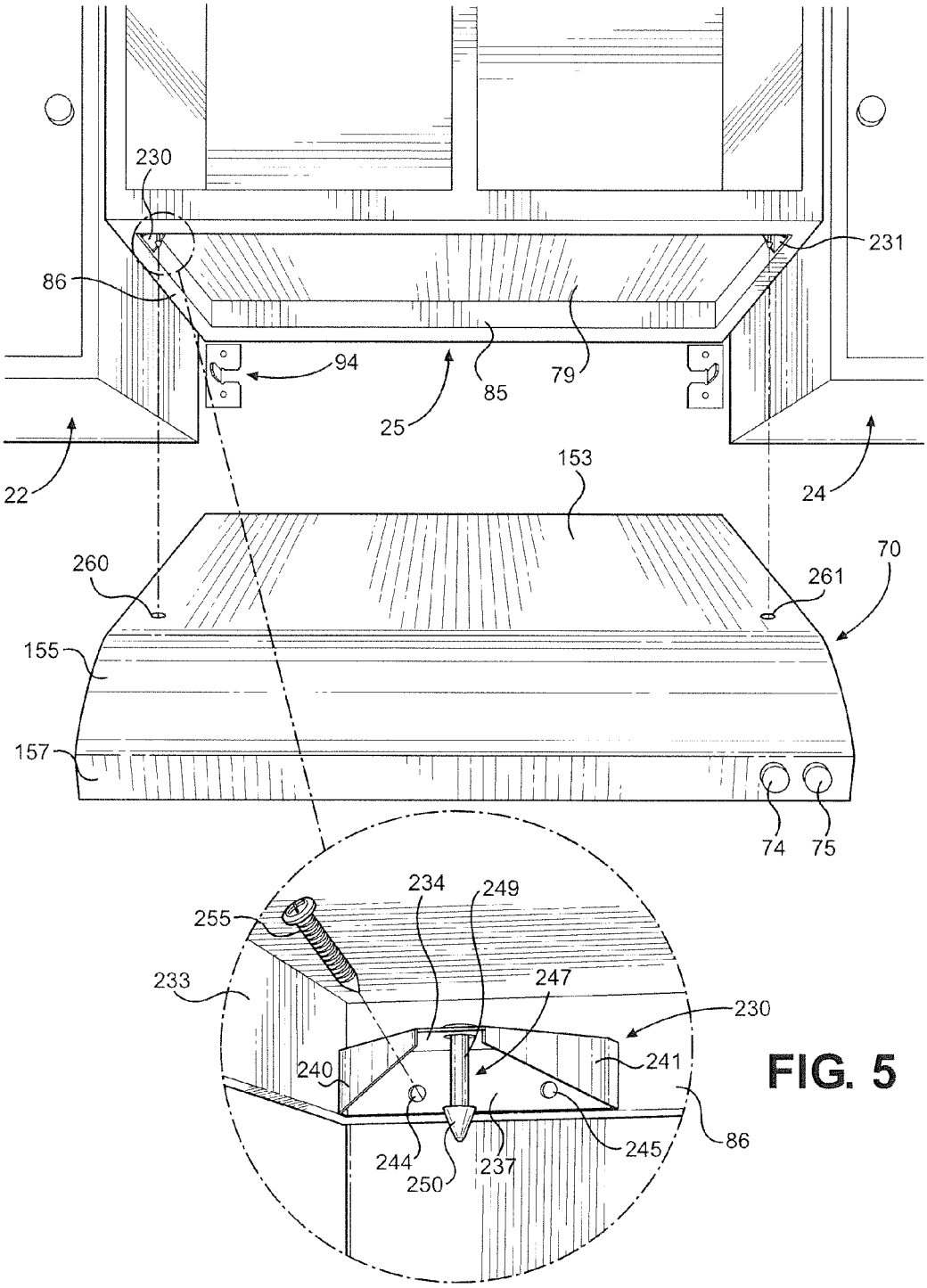
FIG. 5 presents an exploded view for a third embodiment.

As indicated above, the disclosed mounting system takes advantage of the fact that the lateral distance spanning the outermost edge portions 89 of the lower support frame 82 is standard for a given width cabinet 25 such that, with a corresponding ventilation hood 70, slots 124 can be pre-formed in rear panel 122 for accurate alignment with projections 100. In a related fashion, FIG. 5 sets forth an embodiment wherein the front portion of ventilation hood 70 is also supported based on securing mounting blocks 230 and 231 at predetermined frontal corner locations without the need for measurements or templates. More specifically, in the embodiment shown, each mounting block 230, 231 is designed to be mounted in abutment with both a respective side flange piece 86 and a front flange piece 233 of lower support frame 82 as will be described more fully below.

As depicted, each mounting block 230, 231 includes an upper plate 234, a back plate 237 and side plates 240 and 241. In one embodiment, mounting blocks 230 and 231 are formed of metal, but could also be formed of other materials, including plastic. In back plate 237, holes 244 and 245 are formed. In addition, projecting downward from and fixedly secured, such through a threaded connection, a welded connection or the like, to upper plate 234 is a connector 247 which is shown to include a shaft 249 and a conical tip 250. Each mounting block 230, 231 is configured to be mounted along a respective side flange piece 86, through mechanical fasteners one of which is shown at 255, while abutting front flange piece 233. The configuration of mounting block 230, 231 is predetermined such that shaft 249 will align with a respective through hole 260, 261 which is pre-formed in top panel 153 of ventilation hood 70. In accordance with this embodiment, once both support brackets 94 and mounting blocks 230 and 231 are secured in place, the rear portion of ventilation hood 70 can be easily supported on brackets 94 and then the front portion can be tilted upward toward the lower support frame 82 such that conical tips 250, which are preferably formed from an elastomeric material, extend into holes 260 and 261 such that connectors 247 are snap-connected to ventilation hood 70. Therefore, at least in situations where the interior lateral dimensions of lower support frame 82 are known, the positioning of holes 260 and 261 and the construction of mounting blocks 230 and 231 can be predetermined to enable mounting of ventilation hood 70 in a quick and easy fashion by a single installer.

Related to the embodiment of FIGS. 4A-4E, FIGS. 6-9 set forth other ways in which ventilation hood 70 can be secured directly from bottom panel 79 of cabinet 25. In each of these embodiments, it should be recognized that top panel 153 of ventilation hood 70 is pre-formed at spaced frontal locations with holes 260 and 261 in a manner corresponding to that referenced above in relation to the embodiment of FIG. 5. In any case, in connection with each of these additional embodiments, holes 265 and 266 must be established in bottom panel 79 of cabinet 25 in alignment with through holes 260 and 261 and then some fastener structure must extend through the aligned holes to complete assembly.

Figure 6:
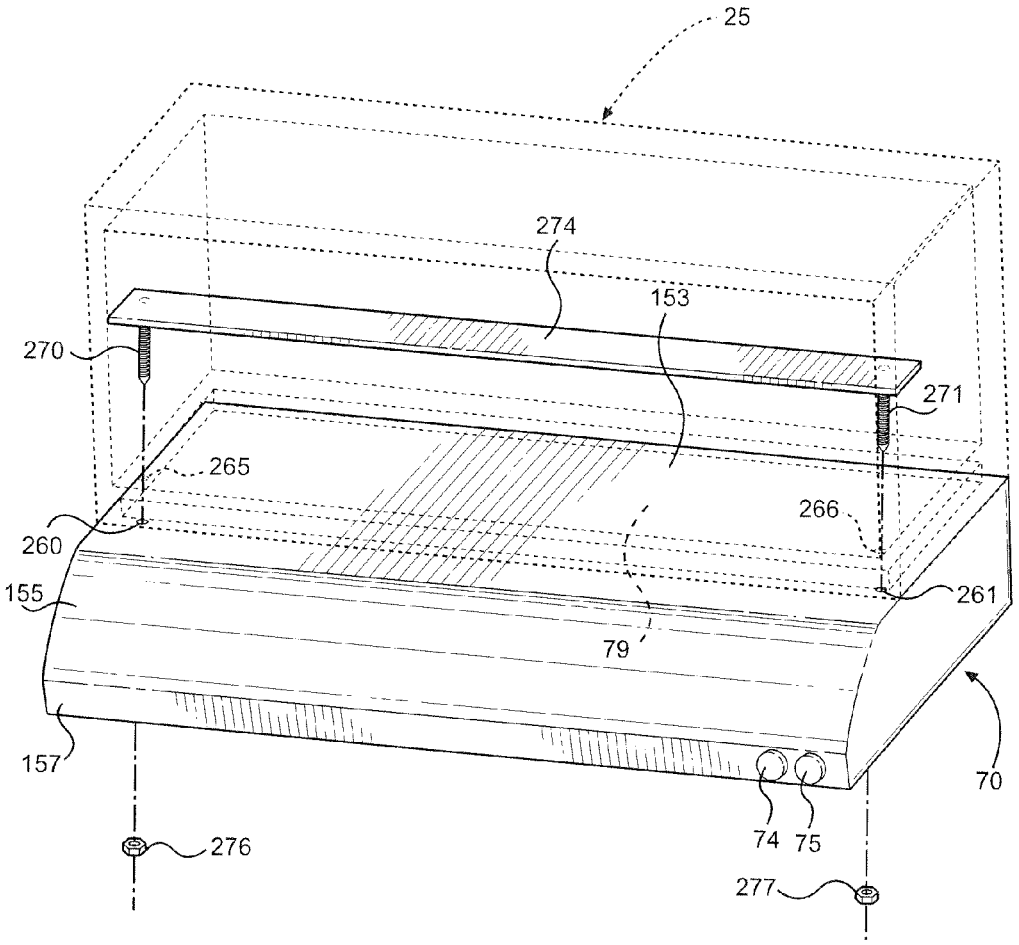
FIG. 6 sets forth a partial exploded view of a fourth mounting embodiment.

In the embodiment represented in FIG. 6, first and second mechanical fasteners 270 and 271 are provided, taking the form of threaded bolts which are interconnected by a plate 274. At this point, it should be realized that, given the existence of holes 260 and 261, ventilation hood 70 can be initially supported on brackets 94 and against the underside of cabinet 25 to enable holes 260 and 261 to act as guides for the formation (e.g., drilling) of holes 265 and 266 in bottom panel 79. However, plate 274 can also be specifically configured based on the known locations of holes 260 and 261 such that, upon placement either within or beneath cabinet 25 and providing mechanical fasteners 270 and 271 with pointed tips (not separately labeled), the pointed tips of mechanical fasteners 270 and 271 can be used to accurately mark locations for drilling holes 265 and 266. In any case, after holes 265 and 266 are formed, mechanical fasteners 270 and 271 can be inserted into holes 265 and 266 respectively, with plate 274 being positioned against bottom panel 79 within cabinet 25. Thereafter, ventilation hood 70 is supported upon brackets 94 and tilted so that mechanical fasteners 270 and 271 also extend through holes 260 and 261, whereupon nuts 276 and 277 are threaded to fasteners 270 and 271 to complete the mounting.

A modified embodiment which is not depicted in the drawings basically represents a configuration based on the embodiments of both FIGS. 4A-4E and FIG. 6 by employing mechanical fasteners which extend through holes 265 and 266 and then are threaded into holes, analogous to holes 179, provided in top panel 153 of ventilation hood 70. That is, instead of extending freely through holes 260 and 261 as in the embodiment of FIG. 6, the mechanical fasteners are threaded to the ventilation hood 70, much like as in the embodiment of FIGS. 4A-4E. In addition, much like the FIG. 6 embodiment, nuts can be employed, with the nuts assuring a secure and long-lasting attachment.

Figure 7A:
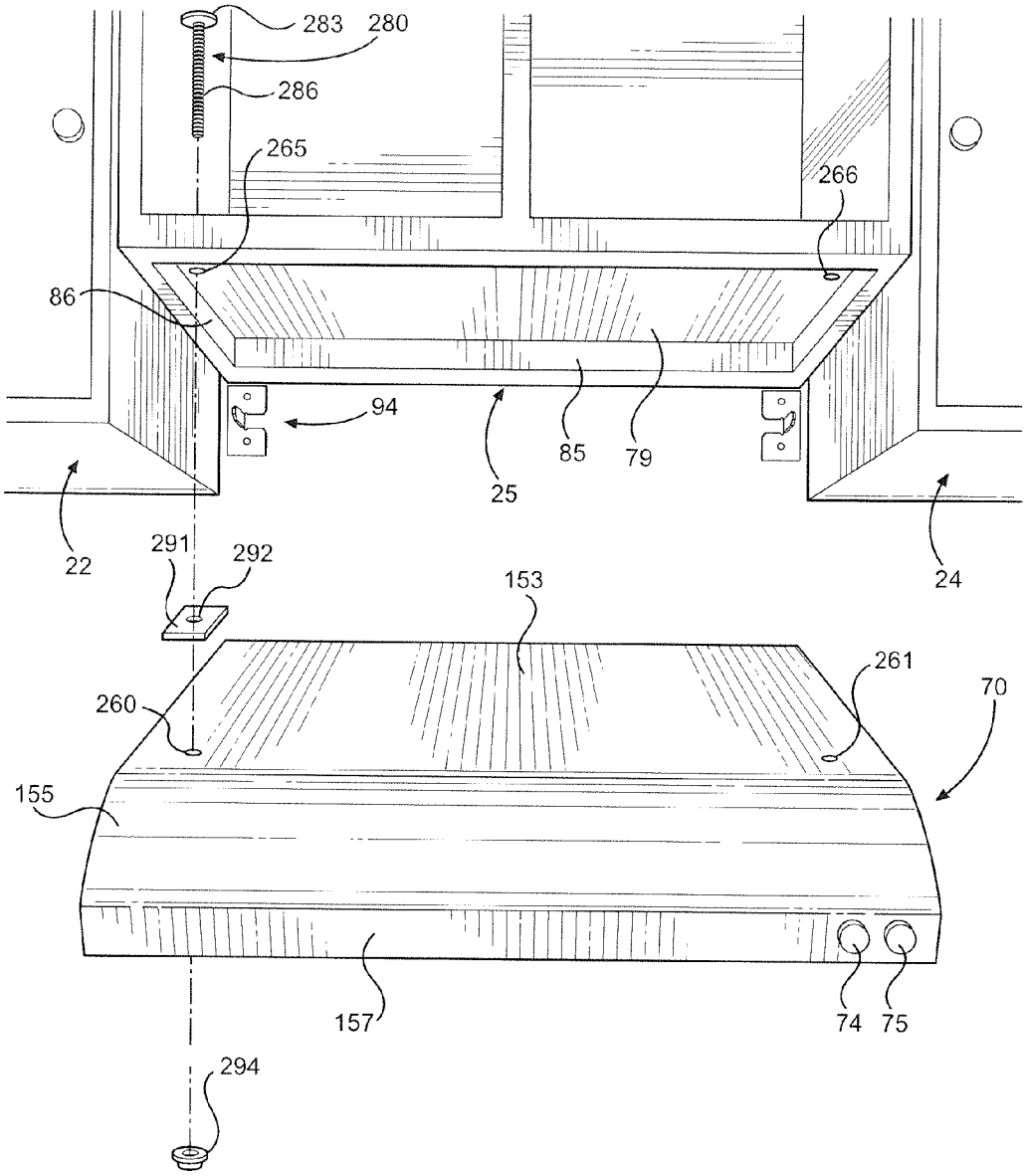
FIG. 7A sets forth a partial exploded view of a fifth mounting embodiment.
Figure 7B:
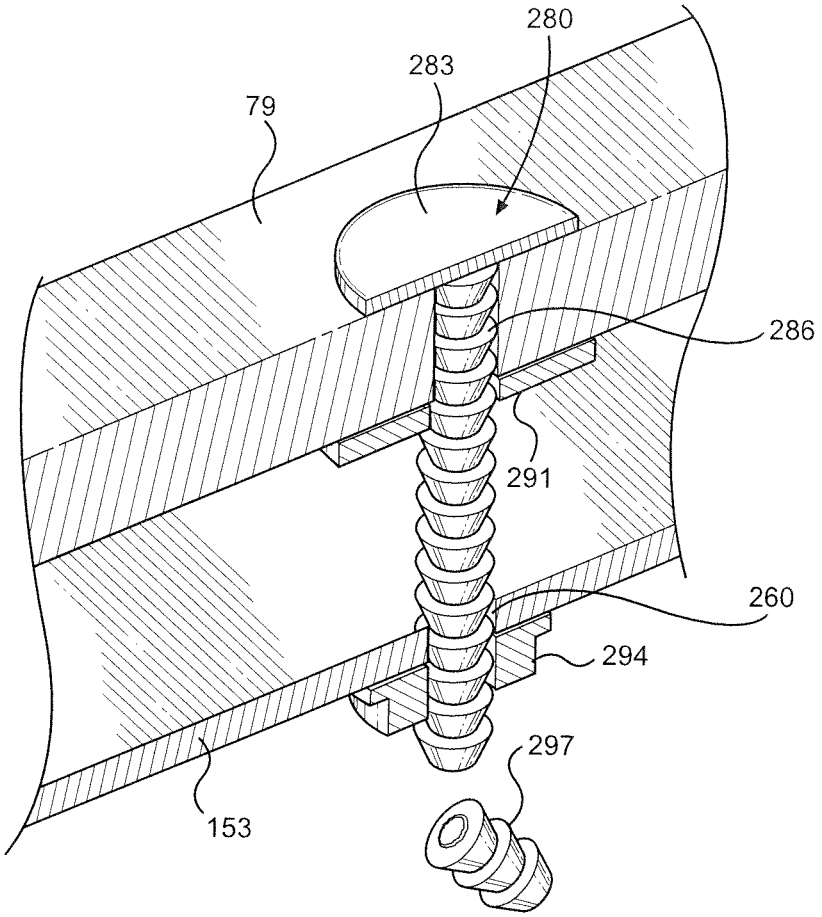
FIG. 7B is an enlarged view of a connector arrangement for the embodiment of FIG. 7A.

FIGS. 7A and 7B set forth an embodiment wherein, instead of using mechanical fasteners 270 and 271 in the form of threaded bolts, zip strips 280 are utilized to secure the front portion of ventilation hood 70 to cabinet 25. As shown in these figures, each zip strip 280 includes a head portion 283 and an elongated body portion 286. This overall assembly is also depicted to include an optional retainer element 291, provided with an aperture 292, and a fastener element 294. In accordance with this embodiment, each zip strip 280 is arranged such that elongated body portion 286 is initially inserted through a respective hole 265, 266 and then snugly into aperture 292 of retainer element 291. While pulling on elongated body portion 286 to retain head portion 283 against bottom panel 79, optional retainer element 291 can be pushed up so as to abut bottom panel 79 beneath cabinet 25. In this fashion, each zip strip 280 will be retained in a desired position with the elongated body portion 286 of each zip strip 280 dangling below cabinet 25. At this point, it should be noted that the optional retainer element 291 can take various forms, such as a plastic element which ratchets along body portion 286, a foam or other material forming block which could have a thickness which spans the filler space established by lower support frame 82, a clip, a clasp or another similar type of retainer element. In any case, once zip strips 280 are mounted, ventilation hood 70 can be supported on brackets 94 and tilted to enable elongated body portions 286 to project through holes 260 and 261. Thereafter, fastener elements 294 are placed on each elongated body portion 286 and, while placing the elongated body portion 286 in tension by pulling thereon, ratcheted upward until abutting top panel 153 while top panel 153 engages cabinet 25. Finally, to complete the assembly, the excess of each elongated body portion 286 can be snipped or otherwise removed as indicated in FIG. 7B at 297.

Figure 8:
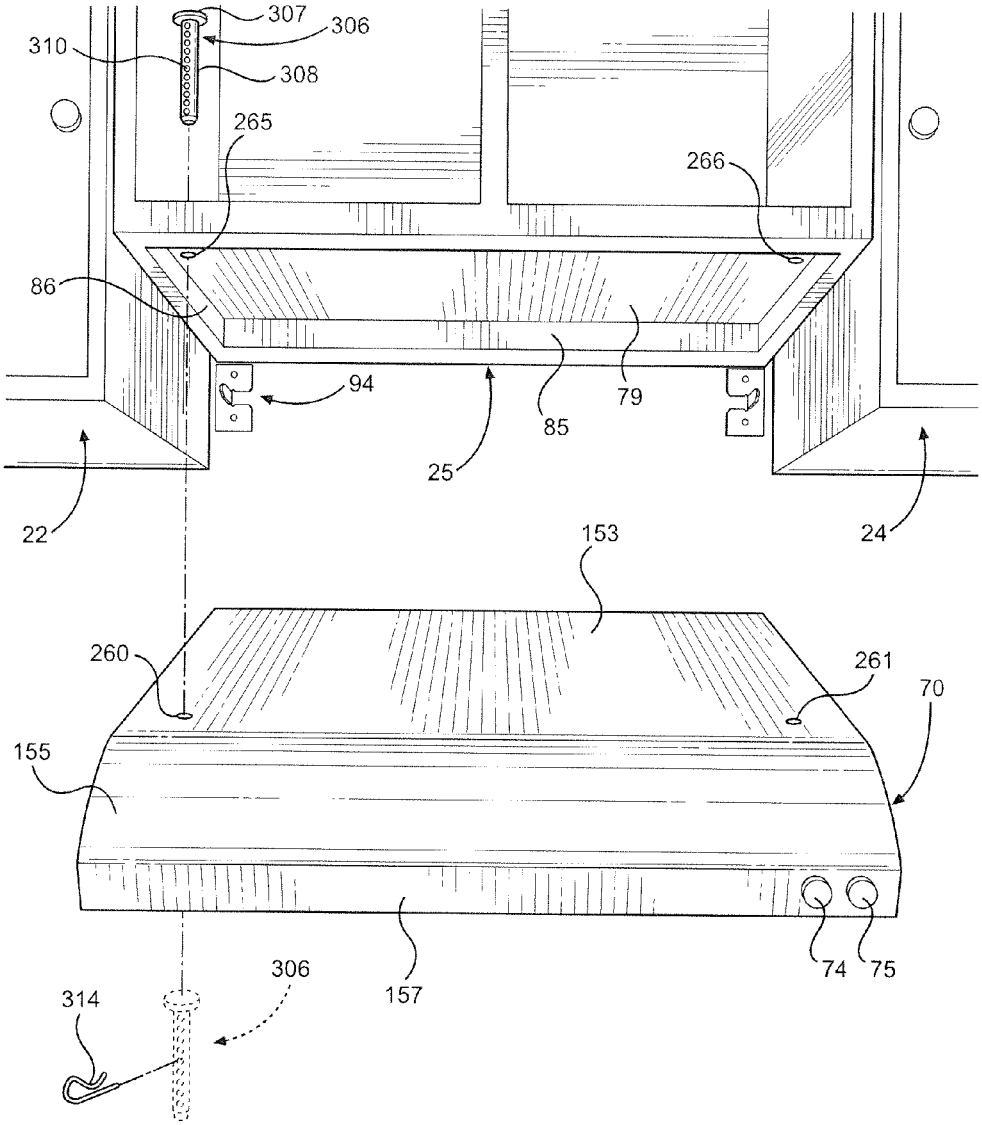
FIG. 8 sets forth a partial exploded view of a sixth mounting embodiment.
Figure 9:
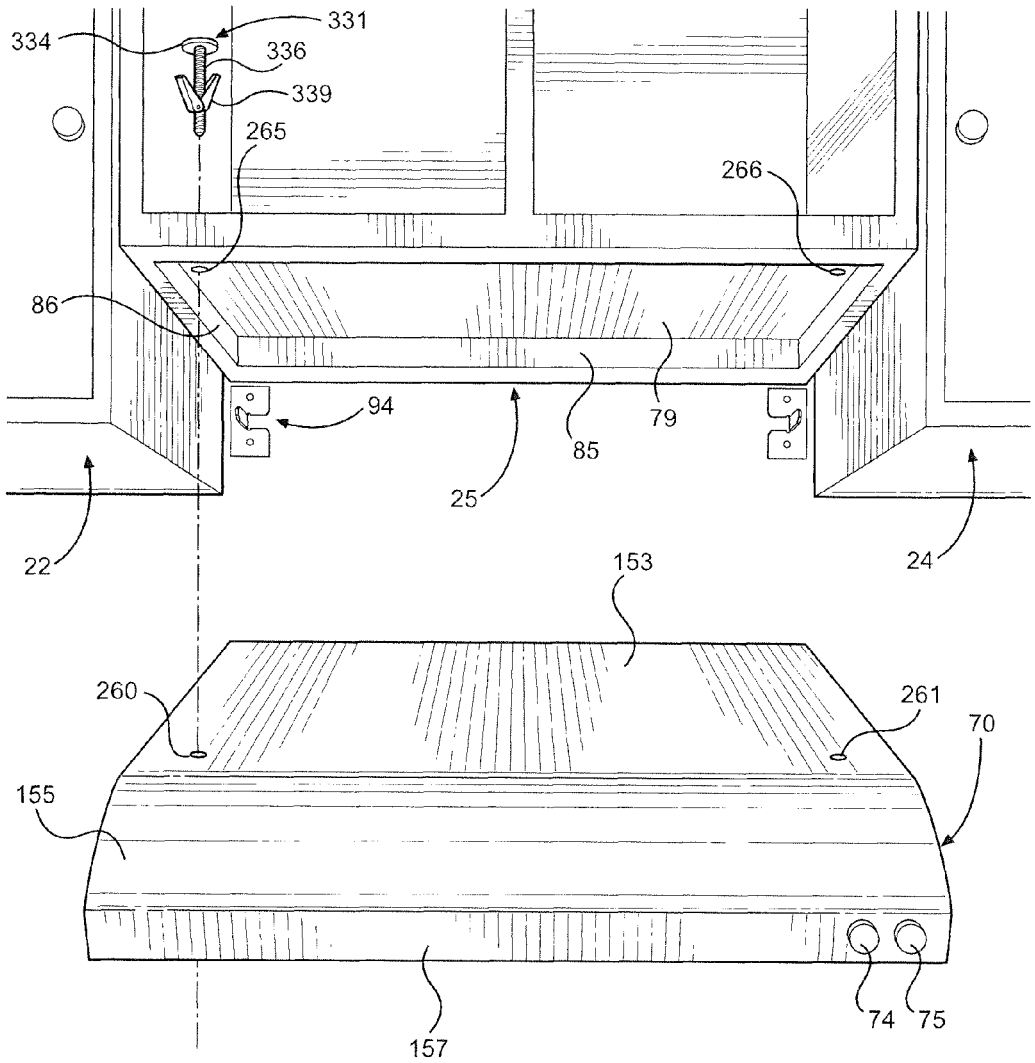
FIG. 9 sets forth a partial exploded view of a seventh mounting embodiment.

Again, as indicated above, once aligned holes 260 and 265, as well as aligned holes 261 and 266, are established, various different types of fastener assemblies can be utilized in connection with securing the front portion of ventilation hood 70. Two additional potential arrangements of this type are represented in the embodiments of FIGS. 8 and 9. In accordance with the embodiment of FIG. 8, bolts 306 having heads 307 and shafts 308 with a plurality of axial spaced and transverse holes 310 are employed. Here, each bolt 306 extends through a respective set of holes 265 and 260 or 266 and 261 in bottom panel 79 and top panel 153, and then a pin 314 is inserted thorough a selected transverse hole 310 to secure the ventilation hood 70 against cabinet 25. In the alternative arrangement of FIG. 9, a toggle bolt 313, having a head 334, a threaded shaft 336 and a nut with pivoting wings 339, is employed for a corresponding purpose.

Although described with respect to preferred embodiments of the invention, it should be readily apparent that various changes and/or modifications can be made to the invention without departing from the spirit thereof. For instance, although the discussed embodiments refer to separate first and second support brackets, as well as first and second fastener assemblies, it should be noted that the invention can be carried out with the first and second support brackets interconnected into an integral member, as well as actually employing one or more fastener assemblies. In addition, based on the above, it should be readily apparent that the invention can employ various different fastener assemblies in connection with an overall system and method for mounting a ventilation hood to an underside of a cabinet, including a bottom panel and a lower support frame, positioned above a cooking appliance. Each embodiment employs the initial mounting of brackets, either separately or an integral member, below the cabinet, against the wall and aligned with outermost edge portions of the lower support frame, with each bracket including some type of projection for engaging and supporting a rear portion of the ventilation hood. In connection with this aspect of the invention, it should be realized that each bracket could be provided with an additional flange to permit an attachment directly to the cabinet support frame, while the bracket is still positioned against the wall. This mounting arrangement could be particularly advantageous when the alternative is mounting the bracket only to drywall mounting between adjacent wall studs. Furthermore, each embodiment employs one or more fastener assemblies attaching a front portion of the ventilation hood to the cabinet. Each of the embodiments is designed to assure that the ventilation hood can be mounted in an easy and efficient manner by a single person, without the need for measuring, cutting and installing filler strips as common in the art.

Figure 10:
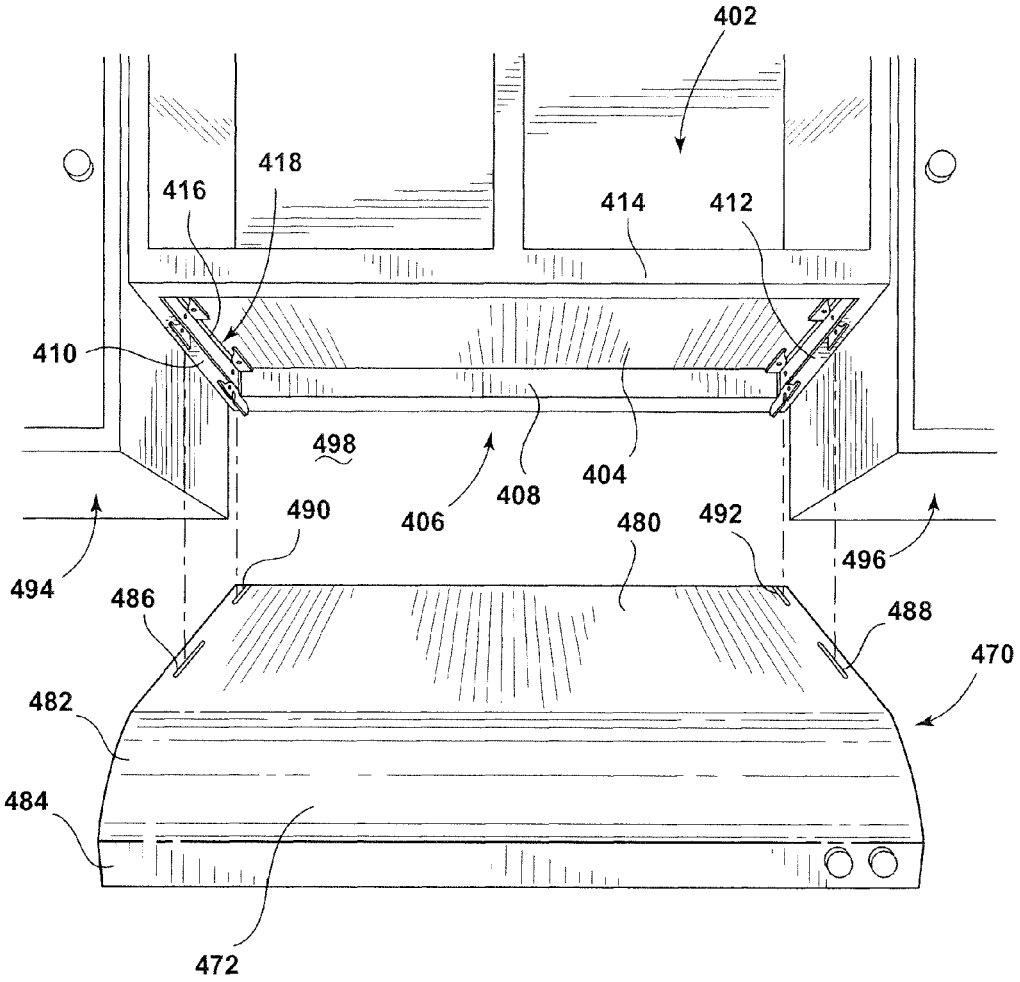
FIG. 10 is a partial exploded view of a first stage in the mounting of the ventilation hood of FIG. 1 in accordance with the invention.

In accordance with another aspect of the invention, as illustrated in FIG. 10, it is contemplated that central cabinet 402 can include a bottom panel or floor 404 and, in this depicted embodiment, a lower support frame 406, shown to include a rear flange piece 408, opposing side flange pieces 410 and 412, and a front flange piece 414. Each of rear, side and front flange pieces 408, 410, 412 defines a side portion 416 as exemplified by side portion 416 for side flange piece 410.

Figure 11:
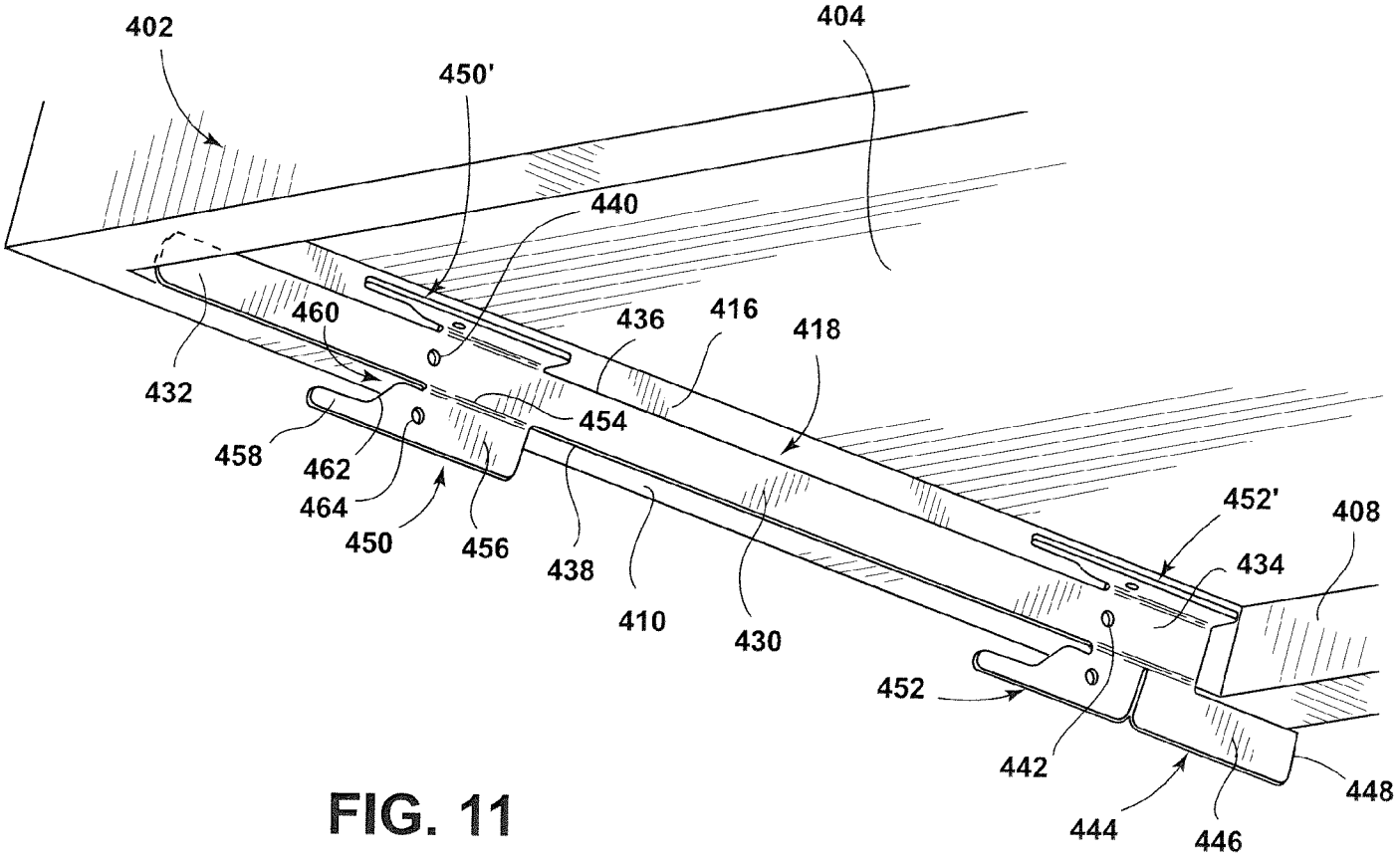
FIG. 11 is a perspective view of an under cabinet support bracket mounting configuration employed in the invention.
Figure 12:
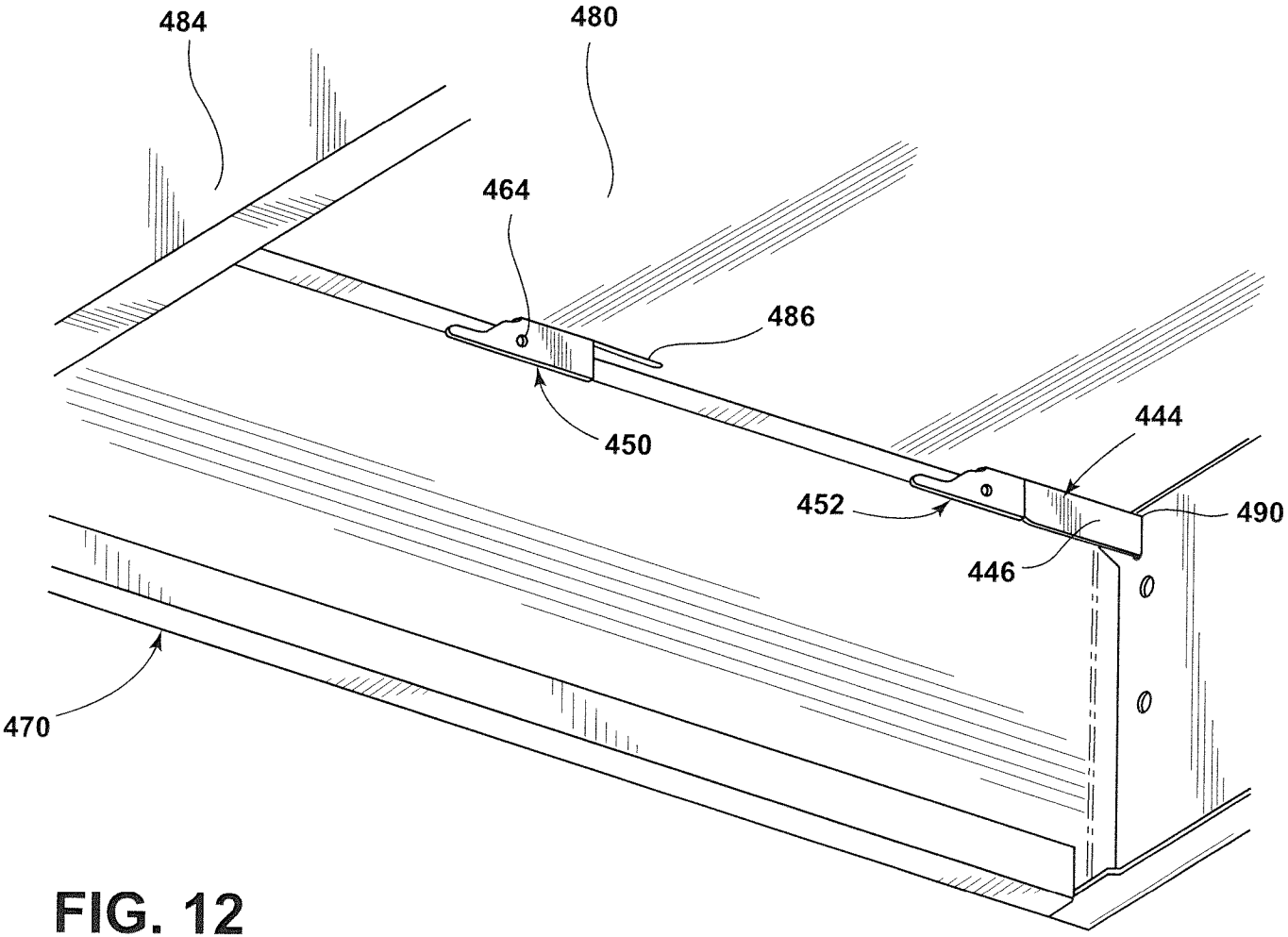
FIG. 12 is a lower perspective view of the ventilation hood of FIG. 1 in an initial mounting stage.

Referring now to the embodiment of FIGS. 10 and 11, support brackets 418 are initially mounted at spaced locations beneath central cabinet 402, i.e., to the underside of cabinet 402. As the support brackets 418 for the opposing sides of cabinet 402 are mirror images of each other, a detailed description of one side support bracket 418 will now be made and it is to be understood that corresponding structure exists in connection with the other side bracket 418. More particularly, for the left side of cabinet 402, a support bracket 418 is shown to include an elongated main body 430 taking the form of a plate having a front end portion 432 and a rear end portion 434 which are longitudinally spaced, as well as an upper edge 436 and a lower edge 438. In or adjacent each end portion 432, 434, elongated main body 430 is provided with spaced holes 440 and 442 respectively. In addition, depending from rear end portion 434 of elongated main body 430 is a locator tab 444 which includes a locator extension 446 having a terminal end 448. As shown, locator extension 446 extends below and generally parallel to elongated main body 430.

Also depending from elongated main body 430 at spaced longitudinal positions are first and second support tabs or hangers 450 and 452. Each of first and second support tabs 450, 452 is generally established by a connection section 454 securing the support tab 450, 452 along lower edge 438 of main body 430, a main section 456, and a cantilevered projection or finger section 458. As clearly illustrated in FIG. 3, between connection section 454 and finger section 458, main body 430 extends for a certain distance spaced from main body 430 such that a slit or recess 460 is established, with slit 460 opening toward finger section 458 and terminating at connection section 454. From slit 460, main body 430 leads to finger section 458 through a tapered or ramped section 462. For reasons which will become more fully evident below, both finger section 458 and slit 460 are sized based on the thickness of the material of housing 472 of ventilation hood 470. Finally, provided within main section 456 is a hole 464. Again, second support tab 452 is similarly constructed to first support tab 450 such that a reiterative description will not be made here. However, it should be noted that, although the various longitudinal dimensions of the various sections of the support tabs 450 and 452 can vary (for instance the main section of support tab 452 is shown to be shorter than the main section of support tab 450), the embodiment depicted illustrates the respective finger sections 458 and slits 460 to have substantially corresponding dimensions.

In the embodiment shown, support bracket 418 is made of sheet metal which is stamped to create each of main body 430, locator tab 444 and first and second support tabs 450 and 452. In addition, although other materials could be employed, housing 472 of ventilation hood 470 is also formed of sheet metal and, as best shown in FIG. 10, includes a top panel 480, a sloping section 482 and a front panel 484 created by bending and shaping a piece of sheet metal. For use in mounting ventilation hood 470, top panel 480 is formed with a pair of spaced, front slots 486 and 488, as well as a pair of spaced, rear slots 490 and 492. As will be detailed more fully below, each pair or set of front and rear slots 486 and 488, 490 and 492 on each side of top panel 480 partially receives a respective support tab 450, 452 for mounting of ventilation hood 470.

In connection with the invention, it is recognized that the outer lateral dimension of lower support frame 406 is standard based on the distance between wall cabinets 494 and 496. Obviously, ventilation hood 470 is dimensioned and manufactured accordingly. However, based on electrical or other issues, the depth of cabinet 402 may not be the same as cabinets 494 and 496. Still, given that the positioning of slots 486-492 are pre-established upon manufacturing of ventilation hood 470, uniformity in the positioning of support brackets 418 and 452 from rear wall 498 is crucial in addressing mounting alignment issues. With this information in mind, the first step in connection with the mounting method for ventilation hood 470 is to mount first and second support brackets 418 to lower support frame 406 and at predetermined positions relative to both rear wall 498 and side flange pieces 410 and 412. More specifically, as exemplified by the left side mounting arrangement of these figures, support bracket 418 is mounted to side flange piece 410 by placing main body 430 against side portion 416, aligning lower edge 438 so as to be flush with a bottom of side flange portion 410 and abutting terminal end 448 of locator extension 446 with rear wall 498. Once properly positioned in this matter, mechanical fasteners, such as wood screws (not shown), are inserted into spaced holes 440 and 442 and driven into side flange piece 410. This same process is then performed for side flange piece 412 such that two fore-to-aft extending support brackets 418 are mounted at spaced locations beneath cabinet 402 with finger sections 458 of support tabs 450 and 452 projecting forward or away from rear wall 498.

Figure 13:
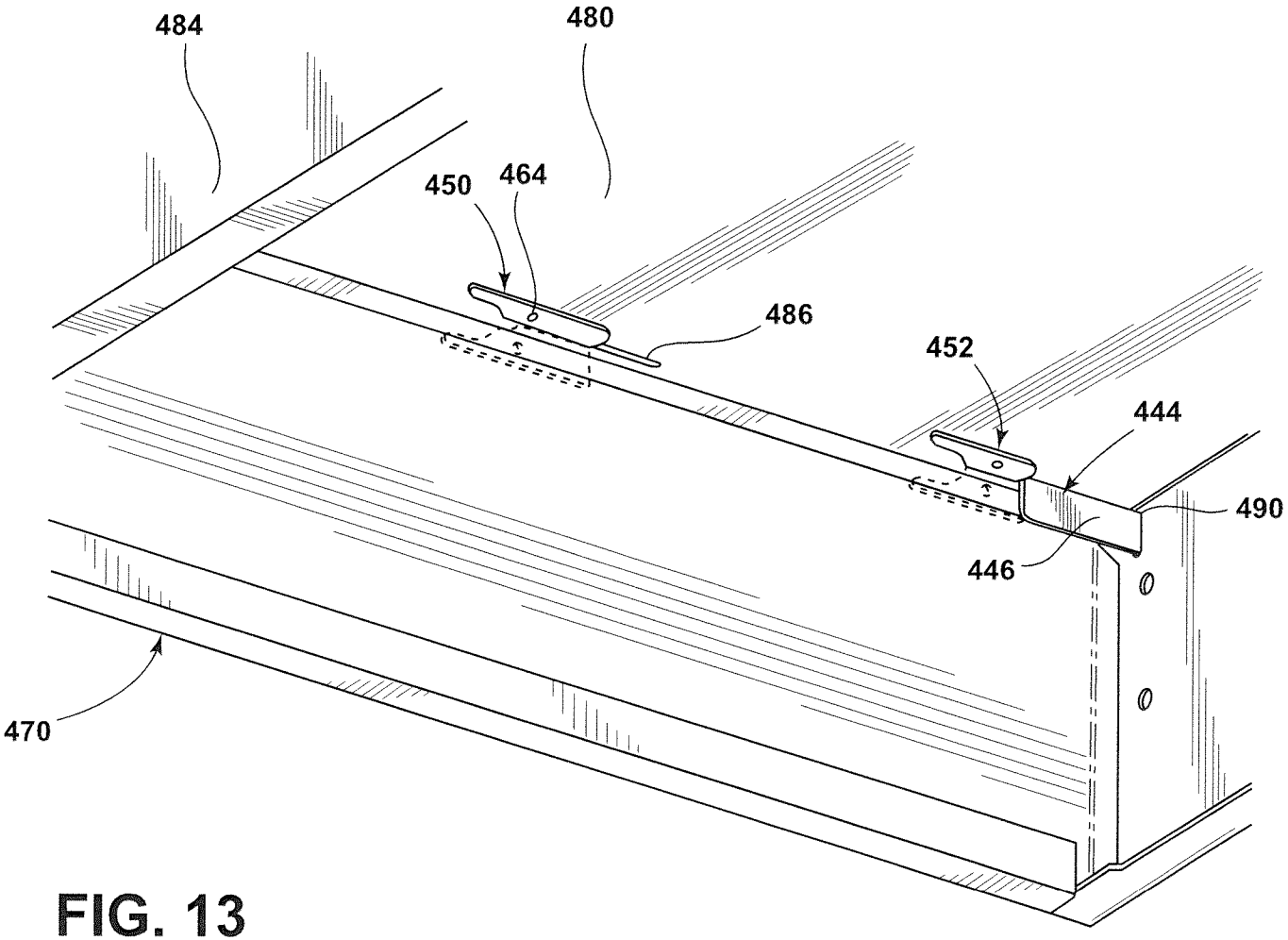
FIG. 13 is a lower perspective view of the ventilation hood in a final mounting stage.

At this stage, ventilation hood 470 can be hung from the spaced support brackets 418 by aligning the respective support tabs 450, 452 on each side of cabinet 402 with a respective pair of front and rear slot 486 and 488, 490 and 492 on each side of top panel 480, inserting each support tab 450, 452 into a respective slot 486-492 and then shifting ventilation hood 470 rearward. With this rearward shifting, a portion of top panel 480 will be received with a respective slit 460 as shown in FIG. 4. During this rearward movement, each tapered section 462 ramps and guides the movement, thereby forcing ventilation hood 470 upward during the rearward shifting and assuring that ventilation hood 470 abuts snugly against central cabinet 402. At the same time, a portion of each locator tab 444 is also accommodated in a respective rear slot 490, 492 as rear slots 490 and 492 open out the back panel (not separately labeled) of ventilation hood 470. Thereafter, each support tab 450, 452 is bent upward against top panel 480 along a respective connection section 454 to assume the position shown in FIG. 13. At this point, aside from any potential electrical issues, the assembly can be considered complete, with ventilation hood 470 being in an operational position. However, it is also proposed in accordance with the invention to provide a further securing feature by enabling one or more mechanical fasteners, such as metal screws (not shown), to extend through hole(s) 464 and into top panel 480.

In the embodiment described above, cabinet 402 is provided with lower support frame 406. However, another standard type of cabinet 402 is frameless such that the lowermost exposed portion would correspond to bottom panel 404. To accommodate use of the invention with this type of known cabinet 402, each support bracket 418 would include support tabs 450' and 452' (see FIG. 11) which are connected to main body 430 along edge 436 at right angles, i.e. perpendicular, to both support tabs 450 and 452 and main body 430. As support tabs 450' and 452' are identically configured to support tabs 450 and 452, the structure thereof will not be repeated. However, for use with this type of cabinet 402, it should be recognized that support bracket 418 is rotated so that main body 430 is flat against bottom panel 404, support brackets 450 and 452 are arranged flush with outermost portions of the cabinet 402 so as to act as spacers which position main body 430 a requisite distance from an outermost lateral edge of cabinet 402 (i.e., a distance equal to the standard thickness of side flange portion 410 or 412), terminal end 448 again abuts rear wall 498 at a height commensurate with main body 430 and ventilation hood 470 is then hung from support tabs 450' and 452' in a manner directly corresponding to that set forth above. Certainly, support tabs 450' and 452' are not needed if mounting ventilation hood 470 to cabinet 402 with lower support frame 406 and the function of support tabs 450 and 452 when utilizing support bracket 418 with a frameless cabinet could be performed by structure lacking at least finger section 458, slit 460, tapered section 462 and hole 464. In addition, even with cabinets lacking lower support frame 406, an outline of the frame to which lower panel 404 is attached can typically be seen so a visual alignment of main body 430 is possible. In any case, when support brackets 418 are structured in the manner illustrated in the figures, it should be apparent that a universal bracket is established in accordance with the invention to enable the mounting of ventilation hood 470 with either type of known cabinetry.

Although described with respect to preferred embodiments of the invention, it should be readily apparent that various changes and/or modifications can be made to the invention without departing from the spirit thereof. For instance, it should be readily apparent that the invention can employ various different fastener assemblies in connection with an overall system and method for mounting a ventilation hood to an underside of a cabinet, including frame-type and frameless cabinets. In addition, although the embodiments described above reference two support tabs on each bracket, it should be recognized that a single, elongate support tab establishing an elongated slit or recess, or more than two support tabs on each bracket, could be employed. In any case, it should be recognized that each configuration provides for the use of support brackets employing distinct aligning (vertically and/or laterally), positioning (fore-to-aft relative to a rear wall) and hanging features which enables a ventilation hood to be mounted in an easy and efficient manner by a single person, without the need for measuring, cutting and installing filler strips as common in the art.

In accordance with another aspect of the system, as illustrated in FIGS. 14-23, wherein new reference numerals are included except where specifically indicated, reference numeral 610 generally refers to a mounting system for mounting a ventilation hood 612 to an underside 614 of a wall cabinet 616, wherein the mounting system 610 includes a housing 618 for a ventilation hood 612 and a removable utility structure 620 selectively secured to the housing 618. An aligning mechanism 622 is defined within at least a portion of the removable utility structure 620. The removable utility structure 620 is operable between at least one measuring position defined by the aligning mechanism 622 locating at least one respective vent-hood anchorage point proximate the wall cabinet 616, and a structural position 624. The structural position 624 of the removable utility structure 620 is defined by the removable utility structure 620 being secured to the housing 618. At least one hanger stud 626 is adapted to at least partially secure the housing 618 proximate the wall cabinet 616, wherein at least one hanger stud 626 is installed proximate the respective anchorage point. In the various embodiments, it is contemplated that the anchorage points are positioned within a wall located proximate the wall cabinet 616.

Figure 14:
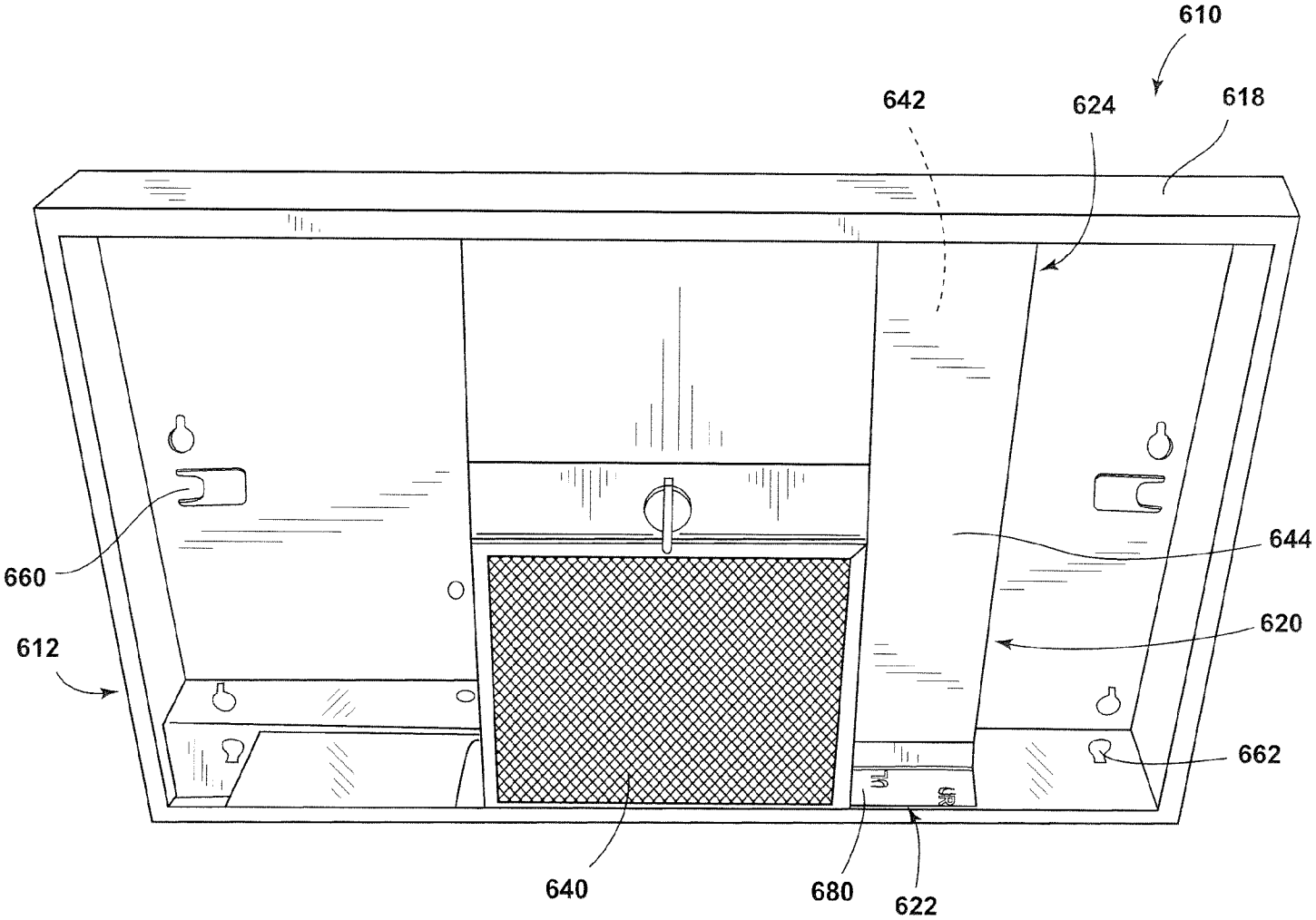
FIG. 14 is a bottom perspective view illustrating a ventilation hood before installation proximate an underside of a wall cabinet above a range in a kitchen environment.
Figure 15:
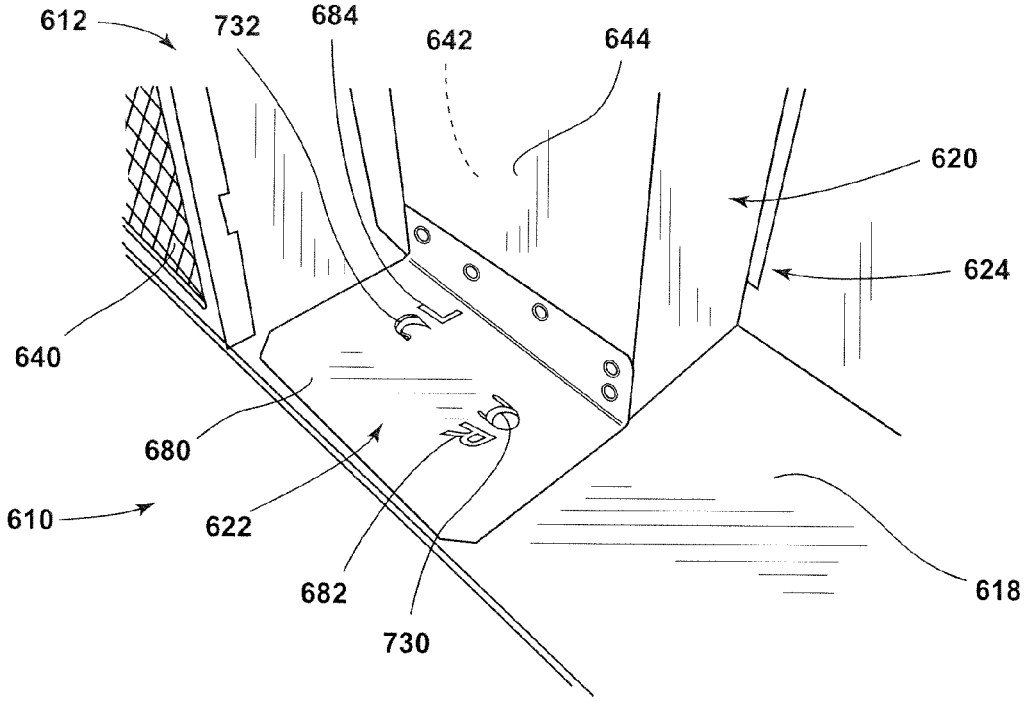
FIG. 15 is a partial bottom perspective view of one embodiment of the aligning mechanism incorporated within the removable utility structure of a housing for a ventilation hood disposed in a structural position.
Figure 16:
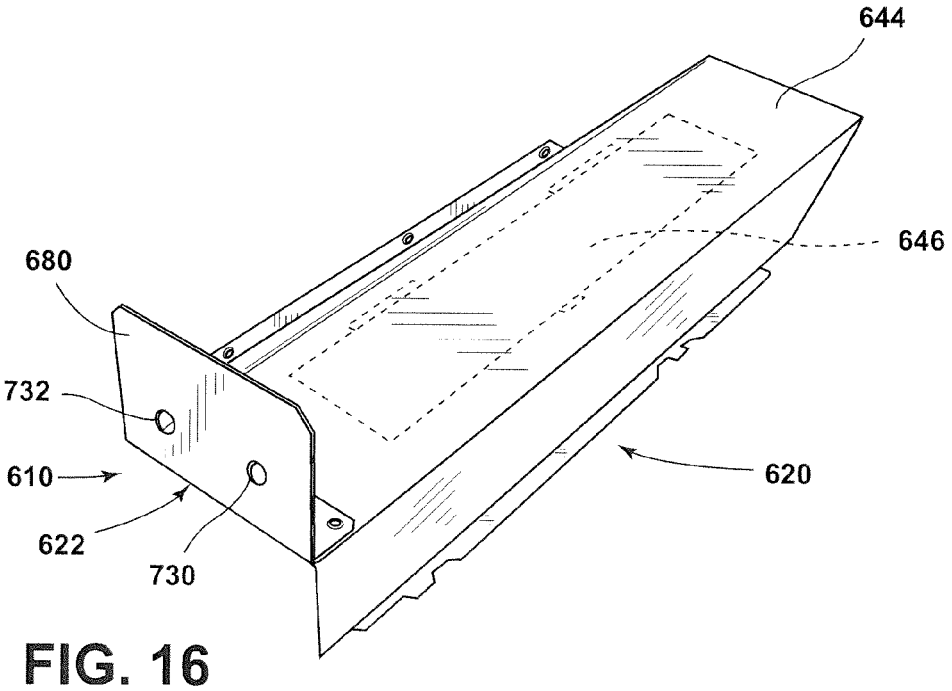
FIG. 16 is a detail perspective view of an embodiment of the removable utility structure of the ventilation hood of FIG. 14.
Figure 17:
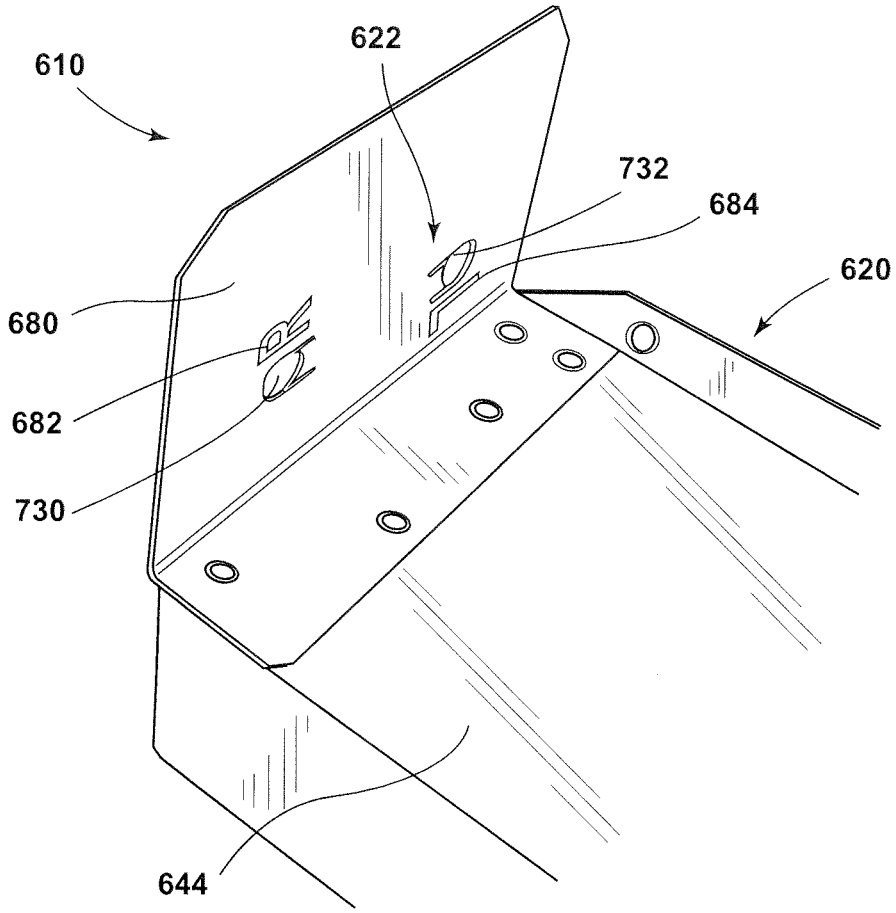
FIG. 17 is a partial perspective view of the aligning mechanism of the removable utility structure of FIG. 16.

Referring again to the embodiment illustrated in FIG. 14, the ventilation hood 612 can include an air handling mechanism 640 and an electrical system 642 that are configured to move air from an area proximate a cooking appliance 2 (shown in FIG. 1) to a separate portion of the space surrounding the cooking appliance. In this manner, the ventilation hood 612 can include various fans, blowers, or other air-handling mechanisms 640 that can be placed in communication with the electrical system 642 of the ventilation hood 612. It is contemplated that the removable utility structure 620 can include an electrical cover 644 adapted to cover at least a portion of the electrical system 642 for the ventilation hood 612 when the removable utility structure 620 is in the structural position 624. In this manner, the removable utility structure 620 can be attached to the housing 618 of the ventilation hood 612 by various mechanical fastening mechanisms that can include, but are not limited to, tabs, hooks, clasps, nut and bolt connectors, or other similar mechanical fastening mechanisms. In embodiments utilizing mechanical fasteners for attaching the removable utility structure 620 to the housing 618, the removable utility structure 620 can be selectively removable in order to access portions of the electrical system 642 of the ventilation hood 612. In various alternate embodiments, it is contemplated that the removable utility structure 620 can be welded, adhered, or otherwise affixed to the housing 618 to substantially secure the removable utility structure 620 to the housing 618 of the ventilation hood 612. In such an embodiment, the removable utility structure 620 can include a separate door, opening, or access panel 646 (shown in FIG. 16) in communication with the electrical cover 644 to provide access through the removable utility structure 620 to the electrical system 642 of the ventilation hood 612.

Referring again to the embodiment illustrated in FIGS. 14-22, the housing 618 of the ventilation hood 612 can include one or more tabs 660 that can be bent, twisted, or otherwise manipulated into one or more positions to install the housing 618 in the ventilation hood 612 to the underside 614 of the wall cabinet 616. The housing 618 can also include various mounting apertures 662 that are configured to receive and/or rest upon various fasteners that are secured to a portion of the wall 712, wall cabinet 616, other supporting structure or a combination thereof. It is contemplated that after such a fastener, which, in various embodiments, can include the hanger studs 626, is disposed within either the wall 712 and the wall cabinet 616, or another similar location, the various mounting apertures 662 of the housing 618 can be placed upon a portion of the fastener such that the housing 618 can rest upon the fastener at one or more of the mounting apertures 662 defined within the housing 618.

Referring now to the embodiment illustrated in FIGS. 15-19, the removable utility structure 620 can include an alignment flange 680 that is configured to contain at least a portion of the aligning mechanism 622 of the mounting system 610. In the various embodiments, the aligning mechanism 622 can include first and second indicia 682, 684 adapted to locate the at least one anchorage point, which can include first and second anchorage points 686, 688, respectively, for attaching various hanger studs 626 upon which the housing 618 for the ventilation hood 612 can be at least partially secured in a pre-install position 690 (shown in FIG. 22), as will be described more fully below. It is contemplated that the alignment flange 680 of the removable utility structure 620 can include the first and second indicia 682, 684. It is also contemplated that, by using the removable utility structure 620 for locating the first and second anchorage points 686, 688 for mounting the housing 618, a single person can locate these points and mount the housing 618 without additional assistance. As such, it is not necessary to have one person lift and hold the housing 618 in a predetermined position so that another person can mark off the first and second anchorage points 686, 688. Due to lightweight nature of the removable utility structure 620, a single person can undertake the process for mounting the housing 618 substantially without assistance.

Referring again to the embodiment illustrated in FIGS. 15-19 and 22, the various measuring positions of the removable utility structure 620 can include a first measuring position 710 defined by the first indicia 682 locating a first anchorage point 686 upon a wall 712 proximate the underside 614 of the wall cabinet 616. In this manner, one of the hanger studs 626 can be selectively secured proximate the first anchorage point 686, such that the hanger stud 626 can receive at least a portion of the housing 618 to substantially secure the housing 618 in the pre-install position 690. The measuring position of the removable utility structure 620 can also include a second measuring position 716 that is defined by the second indicia 684 locating a second anchorage point 688 for substantially securing another hanger stud 626 proximate the second anchorage point 688. In this manner, the hanger studs 626 can be adapted to substantially secure the housing 618 of the ventilation hood 612 in the pre-install position 690, as will be described more fully below.

As illustrated in the embodiment of FIGS. 15-19 and 22, the alignment flange 680 of the removable utility structure 620 can include first and second apertures that are positioned proximate the first and second indicia 682, 684, respectively. The first and second apertures provide openings through the alignment flange 680 such that when the removable utility structure 620 is positioned in the first and second measuring positions 710, 716 the user of the mounting system 610 can conveniently mark the locations of the first and second anchorage points 686, 688 upon the wall 712 for installation of the hanger studs 626. The first and second apertures can also be sized such that the user can pre-drill openings within the wall 712 proximate the wall cabinet 616 into which the hanger studs 626 can be installed for mounting the housing 618 of the ventilation hood 612 in the pre-install position 690. It is further contemplated that each hanger stud 626 can include a head portion 740, such as a hex head, Phillips head, flat head, Allen wrench head, or other head portion 740 (shown in FIGS. 20 and 21), such that the hanger stud 626 can be installed directly into the wall 712 through the first and/or second apertures directly into the first and second anchorage points 686, 688, without the need for pre-marking the first and second anchorage points 686, 688. In such an embodiment, the head portion 740 is typically smaller than the first and second apertures 730, 732 so that the removable utility structure 620 can be removed from the hanger studs 626 and replaced onto the housing 618 in the structural position 624.

Referring again to the embodiment illustrated in FIGS. 15-19, the first and second indicia 682, 684 disposed proximate the first and second apertures each correspond to the first and second measuring positions 710, 716 for locating the first and second anchorage points 686, 688. It should be appreciated that, in various embodiments, the hanger studs 626 can be interchangeable between the first and second anchorage points 686, 688. In alternate embodiments, the hanger studs 626 can be specifically dedicated for installation into corresponding first and second anchorage points 686, 688. The first measuring position 710 of the removable utility structure 620 can correspond to the first anchorage point 686 positioned on the wall 712 near the wall cabinet 616 proximate a predetermined portion of the housing 618 of the ventilation hood 612. Such a predetermined portion can include right or left sides of the ventilation hood 612, upper or lower portions of the ventilation hood 612, central portions of the ventilation hood 612, or other predetermined portion of the housing 618 of the ventilation hood 612. Similarly, the second measuring position 716 can correspond to the location of the second anchorage point 688 disposed on the wall 712 proximate the underside 614 of the wall cabinet 616 to which the ventilation hood 612 is to be installed. In the various embodiments, the first and second indicia 682, 684 and respective first and second apertures 730, 732 can be disposed on opposing sides of the alignment flange 680 of the removable utility structure 620. In this manner, the first measuring position 710 of the removable utility structure 620 can be defined by the removable utility structure 620 being positioned such that the first indicia 682 and corresponding first aperture 730 are disposed in an upward orientation 750 relative to the alignment flange 680 of the removable utility structure 620.

Referring again to the embodiment of FIGS. 15-19, once the first anchorage point 686 is marked, drilled, or otherwise demarcated, the removable utility structure 620 can be removed from the first measuring position 710 and manipulated such that the removable utility structure 620 is disposed in a second measuring position 716. The second measuring position 716 can be defined by the second indicia 684 and corresponding second aperture 732 being disposed in an upward orientation 750 within the alignment flange 680. Once in the second measuring portion 716, the second anchorage point 688 can be marked, drilled, or otherwise demarcated.

It is contemplated that the first and second indicia 682, 684 can include various markings that include, but are not limited to, "right" and "left" designations, various corresponding numbers or letters, graphical indicia such as the proper orientation of the removable utility structure 620 when placed in either the first or second measuring positions 710, 716. Other similar indicia can also be used that are configured to distinguish between the first and second measuring positions 710, 716 of the removable utility structure 620.

It is also contemplated that the first and second indicia 682, 684 can be applied to the alignment flange 680 through various mechanisms that can include, but are not limited to, stickers, decals, writing applied to the surface of the alignment flange 680, or other applied indicia. It is further contemplated that the first and second indicia 682, 684 can be etched, carved, or otherwise defined within the surface of the alignment flange 680 of the removable utility structure 620.

Figure 18:
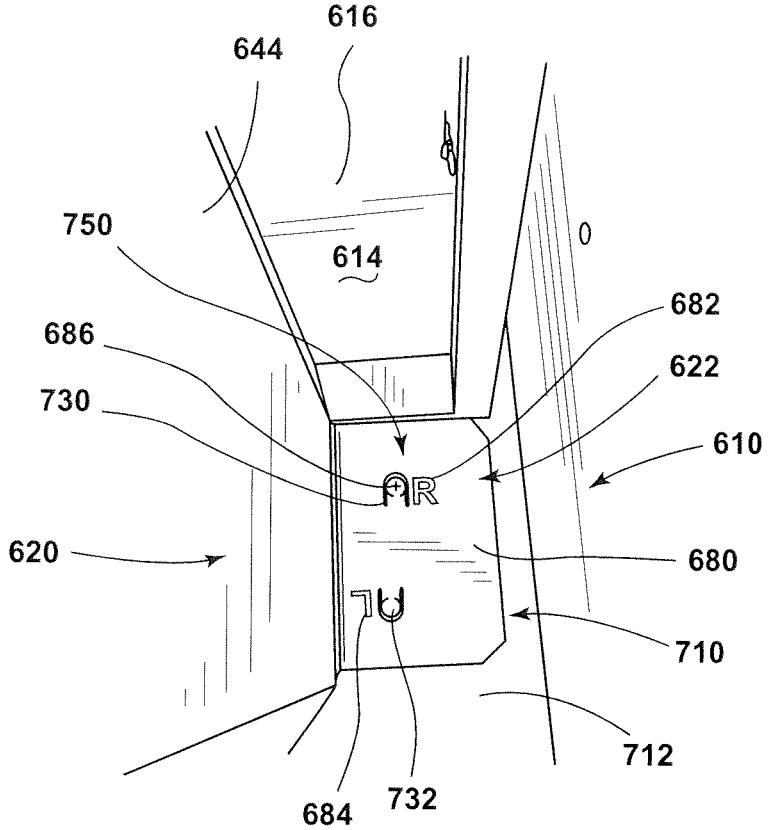
FIG. 18 is a partial perspective view of an embodiment of the removable utility structure disposed in the first measuring position.
Figure 19:
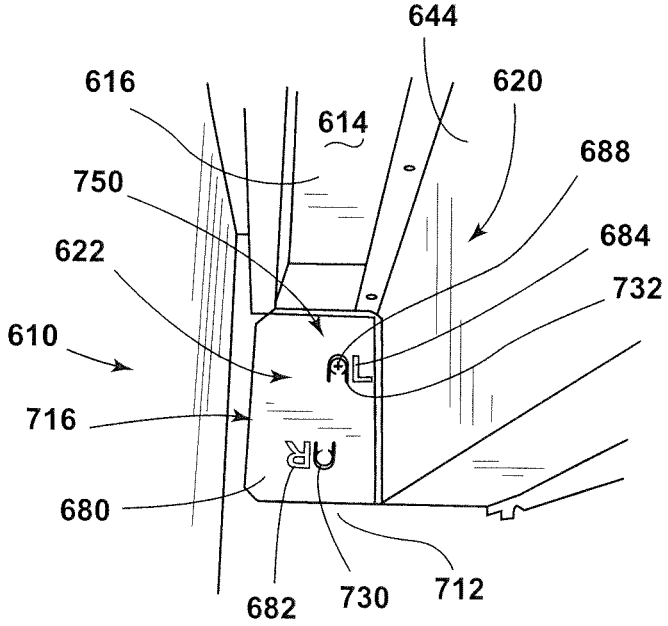
FIG. 19 is a partial perspective view of the removable utility structure of FIG. 18 positioned in the second measuring position.

Referring again to the embodiment illustrated in FIGS. 18 and 19, it is contemplated that the alignment flange 680, in addition to defining the locations of the first and second indicia 682, 684 and corresponding first and second apertures 730, 732, can also be configured as a guide for locating the first and second measuring positions 710, 716. In such an embodiment, the dimensions of the alignment flange 680 can be adapted to position the first and/or second indicia 682, 684 a predetermined distance from the underside 614 of the wall cabinet 616 and/or the wall 712 proximate the wall cabinet 616. The alignment flange 680 can also include various cutouts, chamfers, or other geometries that are configured to engage a portion of the lower support frame (shown in FIG. 2) of the wall cabinet 616. In the various embodiments, it is contemplated that the alignment flange 680 can be a formed portion of one of the panels of the removable utility structure 620, wherein a metal panel of the removable utility structure 620 is bent, formed, or otherwise shaped to define the alignment flange 680. In various alternate embodiments, it is contemplated that the alignment flange 680 can be a separate member that is attached to a portion of the removable utility structure 620. In such an embodiment, the alignment flange 680 can be mechanically fastened, welded, adhered, or otherwise coupled to a portion of the removable utility structure 620.

Figure 20:
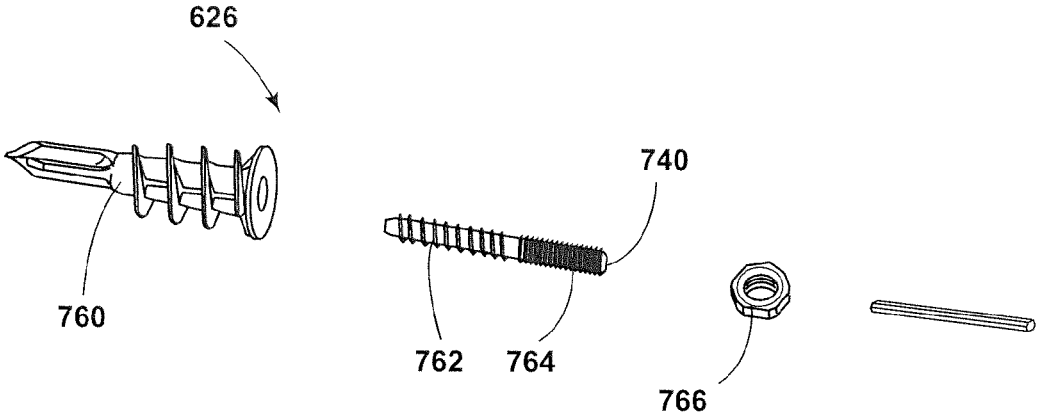
FIG. 20 is a perspective view of one embodiment of the hanger stud in a disassembled state.
Figure 21:
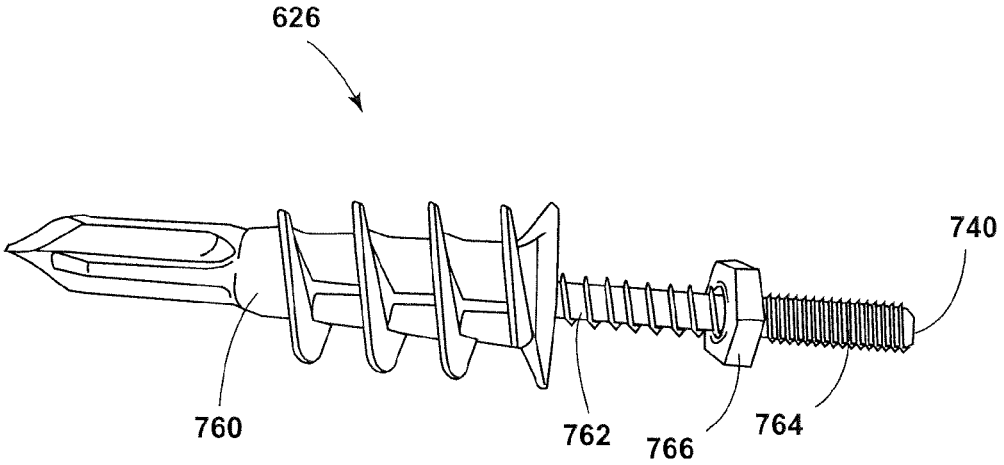
FIG. 21 is a perspective view of the hanger stud of FIG. 20 in an assembled state.
Figure 22:
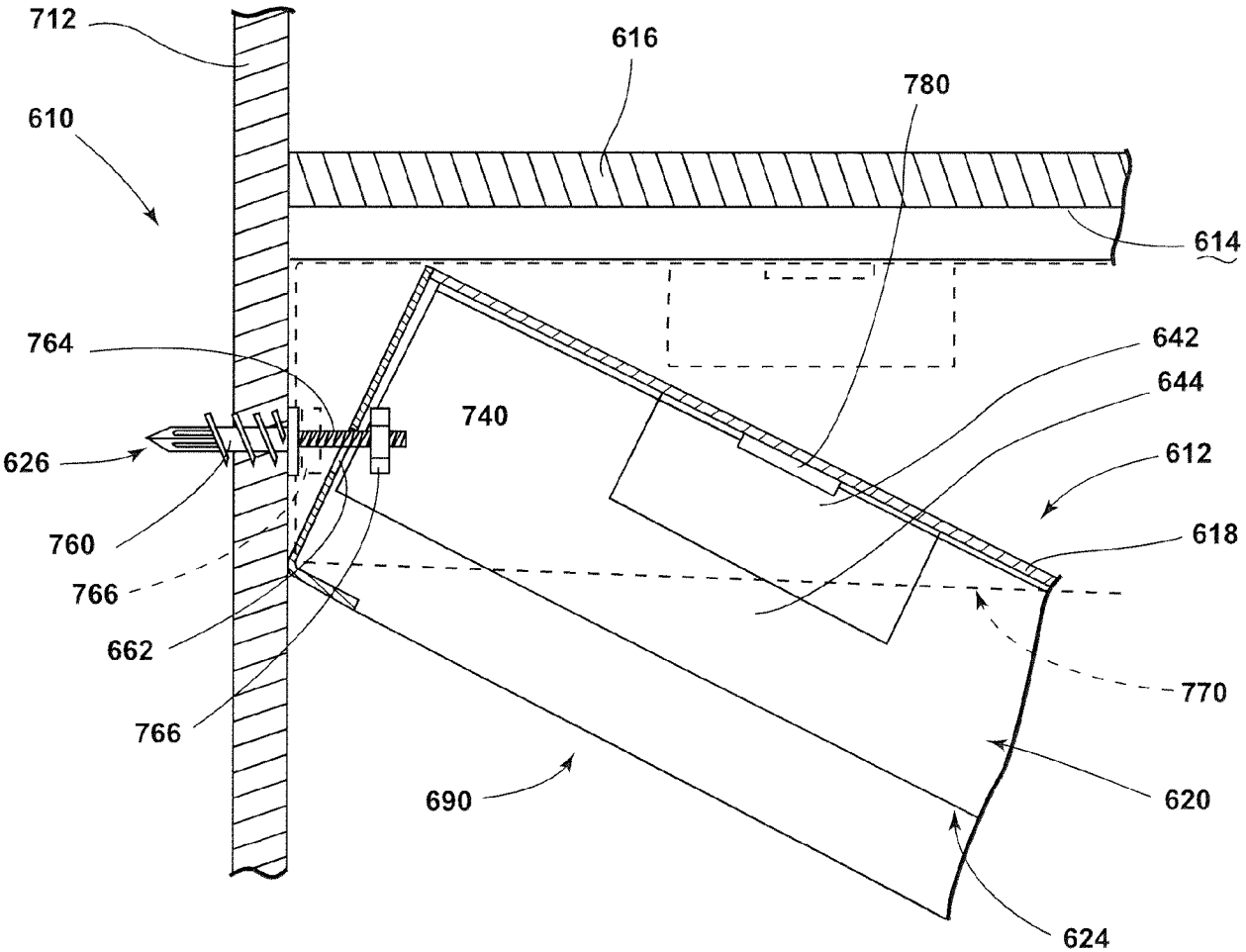
FIG. 22 is a cross-sectional view of the housing of the ventilation hood placed in a pre-install position.

Referring again to the embodiment illustrated in FIGS. 20-22, each hanger stud 626 can include various components that are adapted to cooperate to be secured to the wall proximate the underside 614 of the wall cabinet 616 and also to substantially secure the housing 618 of the ventilation hood 612 under the pre-install position 690. The hanger stud 626 can include various accessory components that can include, but are not limited to, a drywall anchor 760 for installing the hanger stud 626 within a drywall panel proximate an interstitial space of the wall 712 between wall studs, a screw portion 762 of the hanger stud 626 configured to be screwed directly into an aperture of the drywall anchor 760 or into a wall stud of the wall 712 when the first or second anchorage point 686, 688 is aligned with a wall stud. The hanger stud 626 can also include a threaded portion 764 configured to receive a nut 766 or other similar retaining feature.

Referring now to the embodiment illustrated in FIG. 22, in the various embodiments, after the hanger studs 626 are installed within the corresponding first and second anchorage points 686, 688, mounting apertures 662 defined within the housing 618 of the ventilation hood 612 can be placed upon the threaded portions 764 of the hanger studs 626. The nuts 766, caps, or other end pieces can be disposed upon the threaded portions 764 of the hanger studs 626 in order to substantially secure portions of the hood, proximate the mounting apertures 662, between the nut 766 and the wall 712. In this manner, the housing 618 can substantially rest upon the hanger studs 626. Additionally, the nuts 766 disposed upon the threaded portions 764 of the hanger studs 626 substantially prevent the housing 618 from sliding off the threaded portion 764 of the hanger studs 626. Accordingly, the hood can be retained in the pre-install position 690.

In the various embodiments, it is contemplated that the pre-install position 690 is defined by the ventilation hood 612 being disposed below the underside 614 of the wall cabinet 616 and angled downward such that various mechanical or electrical portions of the ventilation hood 612 can be accessed to perform final connection or installation of the various mechanical and electrical components of the ventilation hood 612. As the housing 618 is disposed in the pre-install position 690, the user of the mounting system 610 can access the mechanical and electrical systems 642 of the ventilation hood 612 without requiring another individual to hold the housing 618 in a predetenitined position to access the various systems of the ventilation hood 612. As such, the mounting system 610 is configured to allow a single individual to mount, connect, and install the ventilation hood 612 into an installed position 770, wherein the housing 618 is secured to the underside 614 of the wall cabinet 616 and the mechanical and electrical systems 642 are selectively operable.

Figure 23:
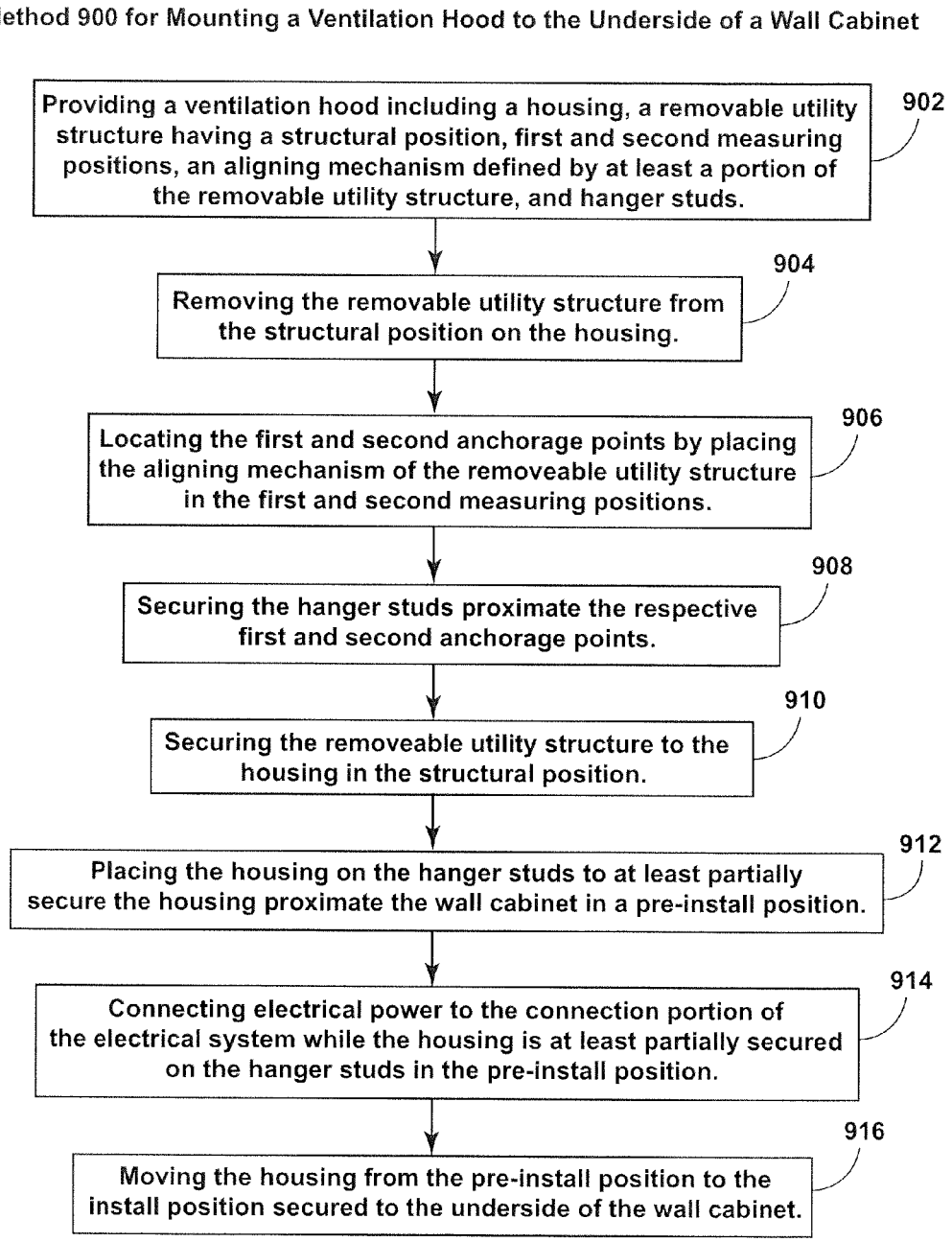
FIG. 23 is a schematic flow diagram illustrating a method for mounting a ventilation hood to an underside of a wall cabinet.

Referring now to the embodiment illustrated in FIGS. 22-23, having described a mounting system 610 for mounting a ventilation hood 612 to an underside 614 of the wall cabinet 616, a method 900 is disclosed for installing the ventilation hood 612 to an underside 614 of the wall cabinet 616, where the method includes the steps of providing a ventilation hood 612 including a housing 618, a removable utility structure 620 having a structural position 624, a first measuring position 710 and a second measuring position 716, an aligning mechanism 622 defined by at least a portion of the removable utility structure 620, and hanger studs 626 (step 902). As discussed above, the removable utility structure 620 can include an electrical cover 644 that is configured to cover and substantially conceal at least a portion of the electrical system 642 of the ventilation hood 612 when the removable utility structure 620 is disposed in the structural position 624. In the various embodiments, the ventilation hood 612 may be provided with the removable utility structure 620 disposed in the structural position 624, such that in order to install the ventilation hood 612 to the underside 614 of the wall cabinet 616, the user must remove the removable utility structure 620 from the structural position 624, such that it can be placed in the first measuring position 710 (step 904). As discussed above, when the removable utility structure 620 is placed proximate the wall cabinet 616 in the first measuring position 710, the aligning mechanism 622 of the removable utility structure 620 is adapted to locate the first anchorage point 686 of the ventilation hood 612. Similarly, when the removable utility structure 620 is placed proximate the wall cabinet 616 in the second measuring position 716, the aligning mechanism 622 of the removable utility structure 620 is adapted to locate the second anchorage point 688 of the ventilation hood 612 (step 906).

Referring again to FIGS. 22-23, once the first and second anchorage points 686, 688 have been located, the user can secure the hanger studs 626 proximate the respective first and second anchorage points 686, 688 (step 908). In the various embodiments, the aligning mechanism 622 of the removable utility structure 620 can include first and second indicia 682, 684 and corresponding first and second apertures 730, 732 through which the user can mark, screw, or otherwise demarcate the first and second anchorage points 686, 688. It is also contemplated that the hanger studs 626 can be screwed directly through the first and second apertures 730, 732 of the aligning mechanism 622 while the removable utility structure 620 is disposed in the corresponding first and second measuring positions 710, 716. Once the hanger studs 626 are disposed proximate the first and second anchorage points 686, 688, the removable utility structure 620 can be returned to the housing 618 and placed in the structural position 624 defined by the removable utility structure 620 at least partially covering an electrical system 642 other than a ventilation hood 612 (step 910). In various embodiments, it is contemplated that the removable utility structure 620 can cover at least a portion of the mechanical system of the ventilation hood 612. It is further contemplated that the removable utility structure 620 can cover at least a portion of both the electrical system 642 and the mechanical system of the ventilation hood 612 when disposed in the structural position 624.

As further illustrated in the embodiment of FIGS. 22-23, after the hanger studs 626 have been substantially secured to the first and second anchorage points 686, 688, the housing 618 can be placed upon the hanger studs 626 to at least partially secure the housing 618 proximate the wall cabinet 616 in the pre-install position 690 (step 912). As discussed above, the pre-install position 690 is defined by the housing 618 being positioned proximate the wall cabinet 616. In this manner, the housing 618 is disposed at an angle below the wall cabinet 616, such that a connection portion 780 of the electrical system 642, the mechanical system, or both, of the ventilation hood 612, is selectively accessible to the user of the mounting system 610. Once the housing 618 is placed in a pre-install position 690, the user can connect at least electrical power to the connection portion 780 of the electrical system 642 while the housing 618 is at least partially secured on the hanger studs 626 in the pre-install position 690 (step 914). It is contemplated that when the housing 618 is in the pre-install position 690, the connection portion 780 can include areas where the user can access the mechanical systems of the vent hood in order to connect and at least partially activate mechanical and electrical systems 642 of the ventilation hood 612. Once the ventilation hood 612 and its electrical and/or mechanical systems are connected, the user can then move the housing 618 from the pre-install position 690 to the installed position 770, wherein the housing 618 is secured to an underside 614 of the wall cabinet 616 (step 916). In this manner, it is contemplated that the nuts 766 positioned on the threaded portions 764 of the hanger studs 626 can be tightened so that the housing 618 is substantially secured upon the hanger studs 626 between the wall 712 and the nuts 766. The various tabs 660 and other securing mechanisms of the ventilation hood 612 can also be connected to secure the ventilation hood 612 in the install position.

It is contemplated that the mounting system 610 described herein and illustrated in FIGS. 14-23, can be used in conjunction with various other systems and methods for mounting an undercabinet ventilation hood 612, such as those described within this application and shown in FIGS. 1-13.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method of mounting a ventilation hood to an underside of a cabinet which is mounted against a wall and includes a bottom panel and a lower support frame positioned above a cooking appliance comprising:

securing a first bracket, including first and second spaced holes, directly to the wall below the cabinet by extending a first mechanical fastener through the first hole;

securing a second bracket, including third and fourth spaced holes, directly to the wall below the cabinet, at a position spaced from the first bracket, by extending a second mechanical fastener through the third hole;

supporting a rear portion of the ventilation hood by the first and second brackets;

securing the ventilation hood to the wall with a third mechanical fastener extending through both a first opening formed in the rear portion of the ventilation hood and the second hole of the first bracket, along with a fourth mechanical fastener extending through both a second opening formed in the rear portion of the ventilation hood and the fourth hole of the second bracket; and fastening a front portion of the ventilation hood through at least one fastener assembly directly to the cabinet.

2. The method of claim 1, further comprising: fixedly securing the first and second brackets to a wall, against which the cabinet is mounted, at positions directly below the cabinet and aligned with outermost edge portions of the lower support frame.

3. The method of claim 2, wherein the first, second, third and fourth mechanical fasteners are threaded fasteners.

4. The method of claim 1, further comprising, after supporting the rear portion of the ventilation hood by the first and second brackets and before fastening the front portion of the ventilation hood to the cabinet, tilting the front portion of the ventilation hood upward into engagement with the cabinet.

5. The method of claim 1, wherein supporting the rear portion of the ventilation hood by the first and second brackets includes inserting tabs projecting from the first and second brackets into slots formed in the rear portion of the ventilation hood.

6. The method of claim 1, wherein fastening the front portion of the ventilation hood includes securing feet members to the ventilation hood and securing mechanical fasteners through the bottom panel of the cabinet and into the feet members.

7. The method of claim 6, further comprising: drilling holes through the feet members and the bottom panel of the cabinet to receive the mechanical fasteners.

8. The method of claim 6, further comprising: vertically adjusting the feet members relative to the front portion of the ventilation hood to alter a distance between the front portion of the ventilation hood and the bottom panel of the cabinet.

9. The method of claim 8, wherein the feet members are vertically adjusted from within the ventilation hood after fastening the front portion of the ventilation hood to the cabinet.

10. The method of claim 9, wherein vertically adjusting each of the feet members includes inserting a tool into a bore formed in a respective one of the feet members and rotating the respective one of the feet members relative to both the ventilation hood and the cabinet.

11. The method of claim 1, wherein fastening the front portion of the ventilation hood includes snap-connecting the ventilation hood to the cabinet.

12. The method of claim 1, wherein fastening the front portion of the ventilation hood includes extending mechanical elements through the bottom panel of the cabinet and through the ventilation hood, then securing the mechanical elements with additional fastener elements from within the ventilation hood.

13. A system comprising: a ventilation hood; a cabinet which is mounted against a wall and includes a bottom panel and a lower support frame positioned above a cooking appliance; first and second brackets each including first and second spaced mounting holes and a tab projecting from between the first and second mounting holes, the ventilation hood including a rear portion provided with a combination of both a slot and an opening at spaced locations, with each slot and opening being configured to be aligned with the tab and the second mounting hole of a respective one of the first and second brackets; first and second mechanical fasteners for extending through the first mounting holes of the first and second brackets, respectively, in mounting the first and second brackets to the wall; third and fourth mechanical fasteners for extending through the openings in the rear portion of the ventilation hood and the second mounting holes of the first and second brackets, respectively, in mounting the ventilation hood to both the first and second brackets and the wall; and at least one fastener assembly attaching a front portion of the ventilation hood to the cabinet.

14. The system of claim 13, wherein the first, second, third and fourth mechanical fasteners are threaded fasteners.

15. The system of claim 13, wherein the at least one fastener assembly includes feet members and additional mechanical fasteners for securing the front portion of the ventilation hood to the cabinet.

16. The system of claim 15, wherein the feet members have external threads engaging the front portion of the ventilation hood and enabling vertical adjustment of the feet members relative to the ventilation hood.

17. The system of claim 16, wherein the feet members include bores for receiving the additional mechanical fasteners.

18. The system of claim 17, further comprising: a tool for insertion into the bores of the feet members for rotating the feet members relative to the ventilation hood.

19. The system of claim 13, wherein the at least one fastener assembly includes snap-connectors for attaching the front portion of the ventilation hood to the cabinet.

* * * * *